US010458211B2

(12) United States Patent
Ford

(10) Patent No.: US 10,458,211 B2
(45) Date of Patent: Oct. 29, 2019

(54) SCREEN FILTER ASSEMBLY AND METHOD THEREFOR

(71) Applicant: Michael Brent Ford, St. George, UT (US)

(72) Inventor: Michael Brent Ford, St. George, UT (US)

( * ) Notice: Subject to any disclaimer, the term of this patent is extended or adjusted under 35 U.S.C. 154(b) by 0 days.

(21) Appl. No.: 16/212,138

(22) Filed: Dec. 6, 2018

(65) Prior Publication Data

US 2019/0106967 A1 Apr. 11, 2019

Related U.S. Application Data

(60) Division of application No. 15/939,839, filed on Mar. 29, 2018, now Pat. No. 10,180,047, which is a continuation-in-part of application No. 15/376,871, filed on Dec. 13, 2016, now Pat. No. 9,957,782.

(51) Int. Cl.

| | |
|---|---|
| ***E21B 43/08*** | (2006.01) |
| ***E21B 17/042*** | (2006.01) |
| ***E21B 43/12*** | (2006.01) |
| ***E21B 34/00*** | (2006.01) |
| ***E21B 34/08*** | (2006.01) |
| ***F04B 53/20*** | (2006.01) |

(52) U.S. Cl.

CPC ..... *E21B 43/088* (2013.01); *E21B 17/042* (2013.01); *E21B 43/084* (2013.01); *E21B 43/126* (2013.01); *E21B 34/08* (2013.01); *E21B 2034/002* (2013.01); *F04B 53/20* (2013.01)

(58) Field of Classification Search

None

See application file for complete search history.

(56) References Cited

U.S. PATENT DOCUMENTS

| | | | | |
|---|---|---|---|---|
| 4,621,987 A * | 11/1986 | Spingath, Jr. | ..... | F04B 53/126 417/313 |
| 2006/0083646 A1* | 4/2006 | Ford | ..... | F04B 53/20 417/555.1 |
| 2009/0053087 A1* | 2/2009 | Ford | ..... | F04B 47/02 417/520 |

* cited by examiner

*Primary Examiner* — Benjamin M Kurtz

(74) *Attorney, Agent, or Firm* — Weiss & Moy, P.C.; Karen J. S. Fouts

(57) ABSTRACT

A screen filter assembly and method for filtering solids within a pump barrel of a pump system. The screen filter assembly is incorporated into a full-length plunger, which contains a screen to filter solids from dirty production fluid. By filtering dirty production fluid, the screen filter assembly keeps the solids off of the plunger and away from the pump barrel.

15 Claims, 16 Drawing Sheets

SCREEN FILTER ASSEMBLY AND METHOD THEREFOR

CROSS-REFERENCE TO RELATED APPLICATIONS

This application is a divisional of and claims benefit to U.S. application Ser. No. 15/939,839 entitled "SCREEN FILTER ASSEMBLY AND METHOD THEREFOR" which was filed on Mar. 29, 2018 in the name of the inventor herein which is a continuation-in-part of and claims benefit to U.S. application Ser. No. 15/376,871 entitled "SCREEN FILTER ASSEMBLY AND METHOD THEREFOR" which was filed on Dec. 13, 2016 in the name of the inventor herein, both of which are incorporated herein in full by reference.

FIELD OF THE INVENTION

The present invention generally relates to oil pumps and screens used, therein, and more specifically, to an improved screen filter assembly and related method therefor.

BACKGROUND OF THE INVENTION

In general terms, an oil well pumping system begins with an above-ground pumping unit, which creates the up and down pumping action that moves the oil (or other substance being pumped) out of the ground and into a flow line, from which the oil is taken to a storage tank or other such structure.

Below ground, a shaft is lined with piping known as "tubing." A sucker rod, which is ultimately, indirectly coupled at its north end to the above-ground pumping unit is inserted into the tubing. The sucker rod is coupled at its south end indirectly to the subsurface oil pump itself, which is also located within the tubing, which is sealed at its base to the tubing. The sucker rod couples to the oil pump at a coupling known as a 3-wing cage. The subsurface oil pump has a number of basic components, including a barrel and a plunger. The plunger operates within the barrel, and the barrel, in turn, is positioned within the tubing.

Beginning at the south end, subsurface oil pumps generally include a standing valve, which has a ball therein, the purpose of which is to regulate the passage of oil (or other substance being pumped) from downhole into the pump, allowing the pumped matter to be moved northward out of the system and into the flow line, while preventing the pumped matter from dropping back southward into the hole. Oil is permitted to pass through the standing valve and into the pump by the movement of the ball off of its seat, and oil is prevented from dropping back into the hole by the seating of the ball.

North of the standing valve, coupled to the sucker rod, is a traveling valve. The purpose of a conventional traveling valve is to regulate the passage of oil from within the pump northward in the direction of the flow line, while preventing the pumped oil from slipping back down in the direction of the standing valve and hole.

In use, oil is pumped from a hole through a series of "downstrokes" and "upstrokes" of the oil pump, wherein these motions are imparted by the above-ground pumping unit. During the upstroke, formation pressure causes the ball in the standing valve to move upward, allowing the oil to pass through the standing valve and into the barrel of the oil pump. This oil will be held in place between the standing valve and the traveling valve. In the conventional traveling valve, the ball is located in the seated position. It is held there by the pressure from the oil that has been previously pumped. The oil located above the traveling valve is moved northward in the direction of the 3-wing cage at the end of the oil pump.

During the downstroke, the ball in the conventional traveling valve unseats, permitting the oil that has passed through the standing valve to pass therethrough. Also during the downstroke, the ball in the standing valve seats, preventing the pumped oil from slipping back down into the hole.

The process repeats itself again and again, with oil essentially being moved in stages from the hole, to above the standing valve and in the oil pump, to above the traveling valve and out of the oil pump. As the oil pump fills, the oil passes through the 3-wing cage and into the tubing. As the tubing is filled, the oil passes into the flow line, from which the oil is taken to a storage tank or other such structure.

Fluid that is pumped from the ground is generally impure, and includes solid impurities such as sand, pebbles, limestone, and other sediment and debris. Certain kinds of pumped fluids, such as heavy crude, tend to contain a relatively large amount of solids.

Solid impurities may be harmful to a pumping apparatus and its components for a number of reasons. For example, sand can become trapped between pump components, causing damage, reducing effectiveness, and sometimes requiring a halt to pumping operations and replacement of the damaged component(s). This can be both time consuming and expensive.

The present invention addresses these problems encountered in prior art pumping systems and provides other, related, advantages.

SUMMARY

In accordance with one embodiment, a screen filter assembly for use with a pump system is disclosed. The screen filter assembly comprises: an upper screen housing adapted to be coupled to a southern end of a top plunger adapter, wherein the upper screen housing comprises: a cylindrical body with a center channel formed therethrough; a screen housed within the body of the upper screen housing; and a plurality of apertures extending through the body of the upper screen housing into the center channel of the upper screen housing; a lower screen housing coupled to a southern end of the upper screen housing, wherein the upper screen housing comprises: a cylindrical body with a center channel formed therethrough; a screen housed within the body of the lower screen housing; a plurality of apertures extending through the body of the lower screen housing into the center channel of the lower screen housing; and a plurality of rings coupled to an outer surface of the lower screen housing and positioned above the plurality of apertures of the lower screen housing.

In accordance with another embodiment, a screen filter assembly for use with a pump system is disclosed. The screen filter assembly comprises: an upper screen housing adapted to be coupled to a southern end of a top plunger adapter, wherein the upper screen housing comprises: a cylindrical body with a center channel formed therethrough; a screen housed within the body of the upper screen housing; a plurality of circular flanges formed on an outer surface of the body of the upper screen housing; a plurality of circular grooves formed by and positioned between the circular flanges formed on the outer surface of the body of the upper screen housing; and a plurality of apertures formed within the circular grooves of the upper screen housing and extending through the body of the upper screen housing into the center channel of the upper screen housing; a lower screen housing coupled to a southern end of the upper screen housing, wherein the upper screen housing comprises: a cylindrical body with a center channel formed therethrough; a screen housed within the body of the lower screen housing; a plurality of circular flanges formed on an outer surface of a bottom portion of the lower screen housing; and a plurality of circular grooves formed by and positioned between the circular flanges on the outer surface of the bottom portion of the lower screen housing; a plurality of apertures formed within the circular grooves of the lower screen housing and extending through the body of the lower screen housing into the center channel of the lower screen housing; a plurality of circular grooves formed on an outer surface of a top portion of the lower screen housing; and a plurality of rings configured to fit within the corresponding plurality of circular grooves formed on the outer surface of the top portion of the lower screen housing.

In accordance with another embodiment, a method for filtering solids from a pump system is disclosed. The method comprises the steps of: providing a screen filter assembly comprising: an upper screen housing adapted to be coupled to a southern end of a top plunger adapter, wherein the upper screen housing comprises: a cylindrical body with a center channel formed therethrough; a screen housed within the body of the upper screen housing; and a plurality of apertures extending through the body of the upper screen housing into the center channel of the upper screen housing; a lower screen housing coupled to a southern end of the upper screen housing, wherein the upper screen housing comprises: a cylindrical body with a center channel formed therethrough; a screen housed within the body of the lower screen housing; a plurality of apertures extending through the body of the lower screen housing into the center channel of the lower screen housing; and a plurality of cut rings coupled to an outer surface of the lower screen housing and positioned above the plurality of apertures of the lower screen housing; passing dirty pumped fluid upwardly through the lower screen housing during a downstroke; filtering the dirty pumped fluid through the screen housed within the body of the lower screen housing; evacuating clean fluid out of the apertures of the lower screen housing; continuing to pass the dirty pumped fluid upwardly through the upper screen housing during the downstroke; filtering the dirty pumped fluid through the screen housed within the body of the upper screen housing; and evacuating clean fluid out of the apertures of the upper screen housing.

In accordance with another embodiment, a screen filter assembly for use with a pump system is disclosed. The screen filter assembly comprises: an upper screen housing adapted to be coupled to a southern end of a top plunger adapter, wherein the upper screen housing comprises: a cylindrical body with a center channel formed therethrough; a screen housed within the body of the upper screen housing; and a plurality of apertures extending through the body of the upper screen housing into the center channel of the upper screen housing; a lower screen housing coupled to a southern end of the upper screen housing, wherein the lower screen housing comprises: a cylindrical body with a center channel formed therethrough; a screen housed within the body of the lower screen housing; a plurality of apertures extending through the body of the lower screen housing into the center channel of the lower screen housing; and a plurality of circular grooves formed on an outer surface of a top portion of the lower screen housing and positioned above the plurality of apertures of the lower screen housing; wherein the screen of the upper screen housing and the screen of the lower screen housing each have a polygonal shape, wherein an outer surface of the screen has multiple straight edges.

In accordance with another embodiment, a method for filtering solids within a pump barrel of a pump system is disclosed. The method comprises the steps of providing a screen filter assembly comprising: an upper screen housing adapted to be coupled to a southern end of a top plunger adapter, wherein the upper screen housing comprises: a cylindrical body with a center channel formed therethrough; a screen housed within the body of the upper screen housing; and a plurality of apertures extending through the body of the upper screen housing into the center channel of the upper screen housing; a lower screen housing coupled to a southern end of the upper screen housing, wherein the lower screen housing comprises: a cylindrical body with a center channel formed therethrough; a screen housed within the body of the lower screen housing; a plurality of apertures extending through the body of the lower screen housing into the center channel of the lower screen housing; and a plurality of circular grooves formed on an outer surface of a top portion of the lower screen housing and positioned above the plurality of apertures of the lower screen housing; wherein the screen of the upper screen housing and the screen of the lower screen housing each have a polygonal shape, wherein an outer surface of the screen has multiple straight edges; passing dirty pumped fluid upwardly through the lower screen housing during a downstroke; filtering the dirty pumped fluid through the screen housed within the body of the lower screen housing; evacuating clean fluid out of the apertures of the lower screen housing; continuing to pass the dirty pumped fluid upwardly through the upper screen housing during the downstroke; filtering the dirty pumped fluid through the screen housed within the body of the upper screen housing; and evacuating clean fluid out of the apertures of the upper screen housing.

In accordance with another embodiment, a screen filter assembly for use with a pump system is disclosed. The screen filter assembly comprises: a plunger, wherein the plunger comprises: a top portion; a body; a center channel formed through the top portion and through the body; and a plurality of apertures extending through the body into the center channel; and a screen housed within the body of the plunger.

In accordance with another embodiment, a screen filter assembly for use with a pump system is disclosed. The screen filter assembly comprises: a plunger, wherein the plunger comprises: a top portion; a body; a center channel formed through the top portion and through the body; a plurality of circular flanges formed on an outer surface of the body; a plurality of circular grooves formed by and positioned between the circular flanges; and a plurality of apertures formed within the circular grooves and extending through the body into the center channel; wherein the top portion of the plunger has a top edge that is angled downwardly and inwardly toward the center channel of the plunger; a screen housed within the body of the plunger; and a retainer ring positioned within the body of the plunger.

In accordance with another embodiment, a method for filtering solids within a pump barrel of a pump system is disclosed. The method comprises the steps of: providing a screen filter assembly comprising: a plunger, wherein the plunger comprises: a top portion; a body; a center channel formed through the top portion and through the body; and a plurality of apertures extending through the body into the center channel; and a screen housed within the body of the plunger; passing dirty pumped fluid upwardly through the plunger during a downstroke; filtering the dirty pumped fluid through the screen; evacuating clean fluid out of the apertures of the plunger; and continuing to pass the dirty pumped fluid upwardly through the center channel of the plunger during the downstroke.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

Figure 1:
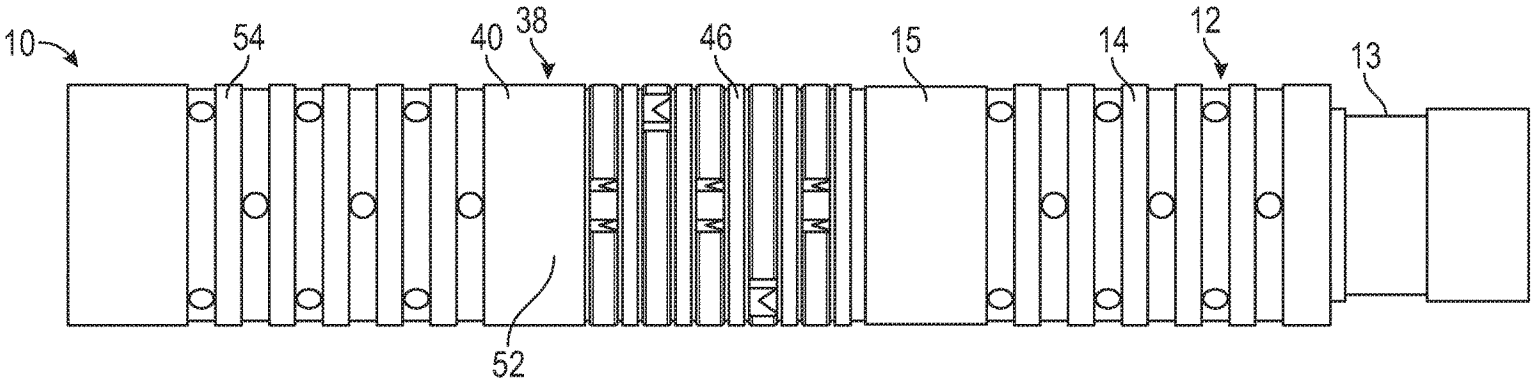
FIG. 1 is a side view of a screen filter assembly in accordance with one or more aspects of the present invention.
Figure 2:
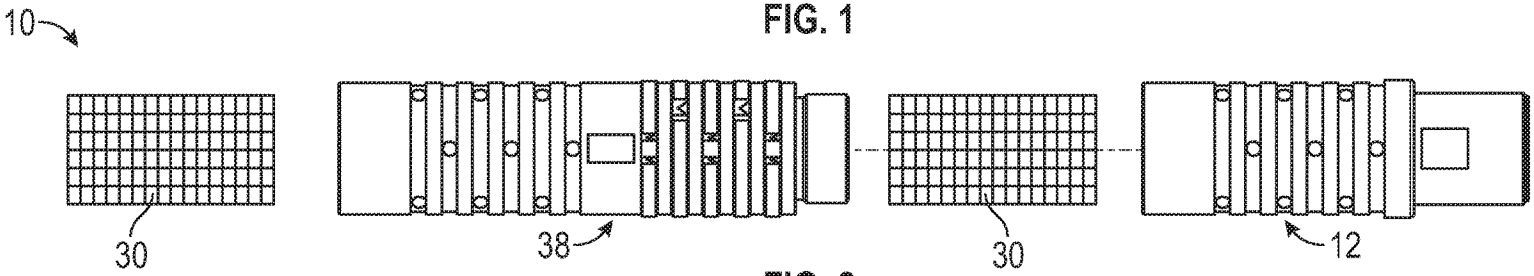
FIG. 2 is a side exploded view of the screen filter assembly of FIG. 1.

FIGS. 1-28, together, disclose embodiments of a screen filter assembly 10 of the present invention. As shown in FIGS. 1-28, the screen filter assembly 10 is adapted to be used with a pump system that is positioned within a pump barrel. Referring to FIGS. 1-2, the screen filter assembly 10 of the present invention may have an upper screen housing 12 and a lower screen housing 38, and a screen 30 positioned in each of the upper screen housing 12 and the lower screen housing 38. The screen filter assembly 10 may be constructed of various lengths, depending upon the particular configurations and conditions of the well in which it is employed. For example, the screen filter assembly 10 may have a length ranging from 8-20 inches, or any other desired length that may be suitable for the particular configurations and conditions of the well in which it is employed.

Figure 3:
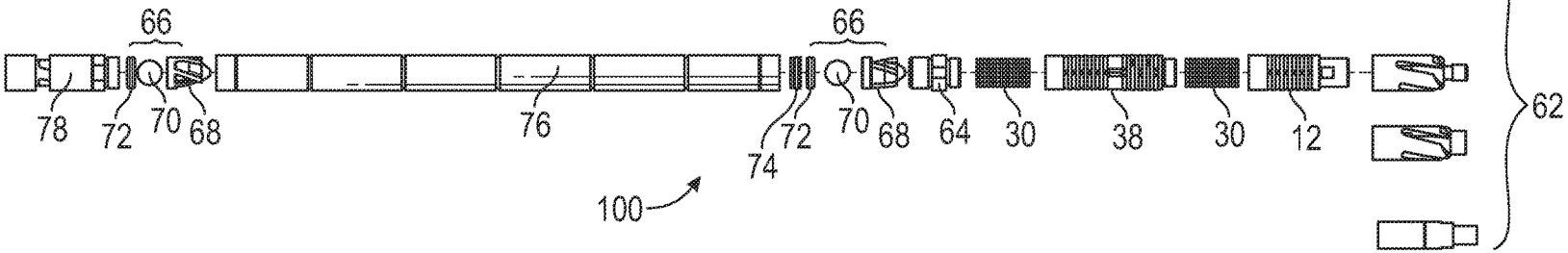
FIG. 3 is a side exploded view of the screen filter assembly of FIG. 1, wherein the screen filter assembly is shown coupled at its north end to a top plunger adapter and coupled at its south end to a plunger.
Figure 4:
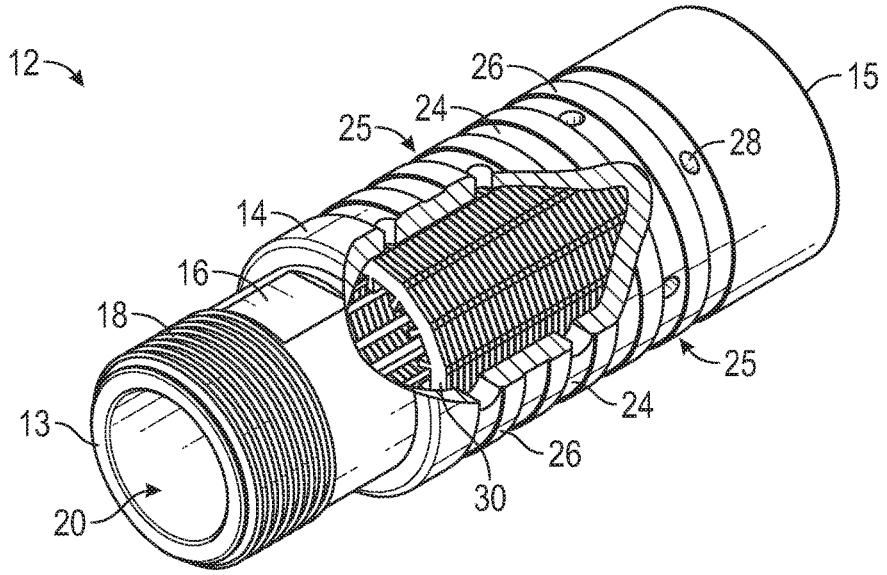
FIG. 4 is a perspective partially cut-away view of an upper screen housing portion of the screen filter assembly of FIG. 1.
Figure 5:
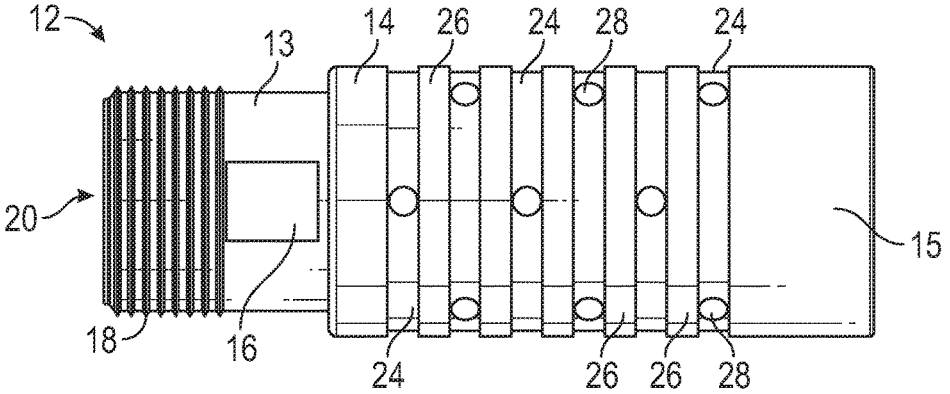
FIG. 5 is a side view of the upper screen housing of FIG. 4.

As shown in FIG. 3, the screen filter assembly 10 may be coupled at its southern end to the northern end of a plunger 76 and the screen filter assembly 10 may be coupled at its northern end to the southern end of any of a number of types of top plunger adapters 62. Here, the screen filter assembly 10 is shown coupled to an adapter 64 which connects the screen filter assembly 10 to a plunger assembly 100 and the plunger assembly 100 comprises a ball valve 66 (made up of a helical insert 68, a ball 70, and a seat 72), a press-fit seat plug 74, a plunger 76, and another ball valve 66 (made up of a helical insert 68, a ball 70, and a seat 72). The southern end of the plunger 76 is shown coupled to the northern end of a traveling valve 78.

FIGS. 4-8 show the upper screen housing 12 of the screen filter assembly 10. The upper screen housing 12 is cylindrical and has a top portion 13 a body 14, a bottom portion 15, and a center channel 20 formed completely therethrough. The top portion 13 of the upper screen housing 12 may have a narrower outer diameter than the body 14 of the upper screen housing 12. The top portion 13 of the upper screen housing 12 may have wrench flats 16 formed thereon and it may also have threading 18 to couple the upper screen housing 12 to a top plunger adapter 62. The bottom portion 15 of the upper screen housing 12 may also have threading 18 to couple the upper screen housing 12 to the lower screen housing 38. The threading 18 may be male or female threading 18, as long as it engages the corresponding male or female threading present on a southern end of the top plunger adapter 62.

The body 14 of the upper screen housing 12 may have a plurality of circular flanges 26 and a plurality of circular grooves 24 formed on its outer surface. Although the upper screen housing 12 is shown as having five circular flanges 26 and six circular grooves 24, it should be clearly understood that any suitable number of circular flanges 26 and grooves 24 may be used. The circular grooves 24 are formed by and are thus positioned between the circular flanges 26. Each circular flange 26 may have a top edge 25 that may be angled downwardly and inwardly toward the center channel 20 of the upper screen housing 12. This downward and inward angle creates a "pocket" or dip that collects solids that are expelled from the center channel 20 of the upper screen housing 12 and out through the apertures 28 formed within the grooves 24. This helps to keep the solids away from the pump barrel. The outer surface of the body 14 may be slightly tapered so that the outer diameters of the circular flanges 26 steadily increase (e.g. by about 0.01 inch) when going from top to bottom. In order words, the circular flange 26 closest to the top portion 13 of the upper screen housing 12 will have the smallest outer diameter and the circular flange 26 closest to the bottom portion 15 of the upper screen housing 12 will have the largest outer diameter.

Figure 6:
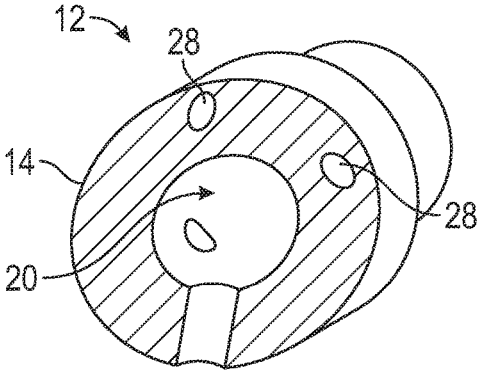
FIG. 6 is a bottom perspective cross-sectional view of the upper screen housing of FIG. 4.
Figure 7:
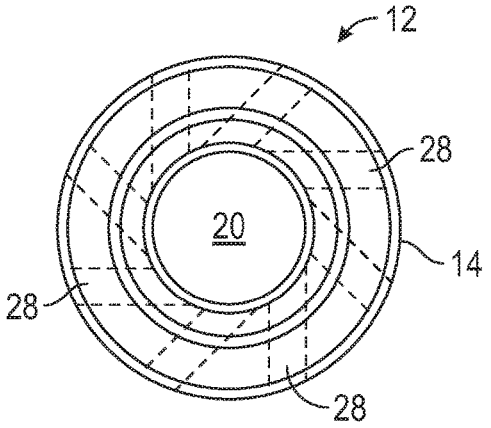
FIG. 7 is a cross-sectional bottom view of the upper screen housing of FIG. 4.

Each circular groove 24 may have a plurality of apertures 28 formed therein. The apertures 28 pass through the body 14 of the upper screen housing 12 and are in fluid communication with the center channel 20 of the upper screen housing 12. Each circular groove 24 can have virtually any number of apertures 28, as can be desired for various well configurations and conditions. In one embodiment, the apertures 28 are evenly spaced around the circular groove 24 on the body 14 of the upper screen housing 12. Preferably, as shown in FIGS. 6-7, from the perspective of the exterior of the upper screen housing 12, each aperture 28 may be angled in a direction that is diagonal to or off-centered from the center channel 20. If the apertures 28 were positioned perpendicularly to the center channel 20, the fluid and solids that are expelled from the apertures 28 would be expelled directly toward the pump barrel, which can cause damage to the pump. Therefore, it is preferable to have the apertures 28 positioned diagonally relative to the center channel 20 (i.e. off-centered) because this allows cyclonic rotation of the fluid and solids that are expelled from the apertures 28 so that they are expelled at an angle and constantly rotated around the upper screen housing 12, thereby preventing the solids from contacting the pump barrel and preventing the solids from accumulating in one particular spot on the top edges 25 of the circular flanges 26.

As shown, the apertures 28 formed in one circular groove 24 may be staggered with the apertures 28 of the circular groove 24 above and/or below it. This aids in the collection and distribution of solids within the pockets or dips of the top edges 25 of the circular flanges 26. If all of the apertures 28 of all of the circular grooves 24 were aligned, this would cause the solids to accumulate in particular spots on the top edges 25 of the circular flanges 26 (in the areas directly below each line of apertures 28), which is not preferable.

Figure 8:
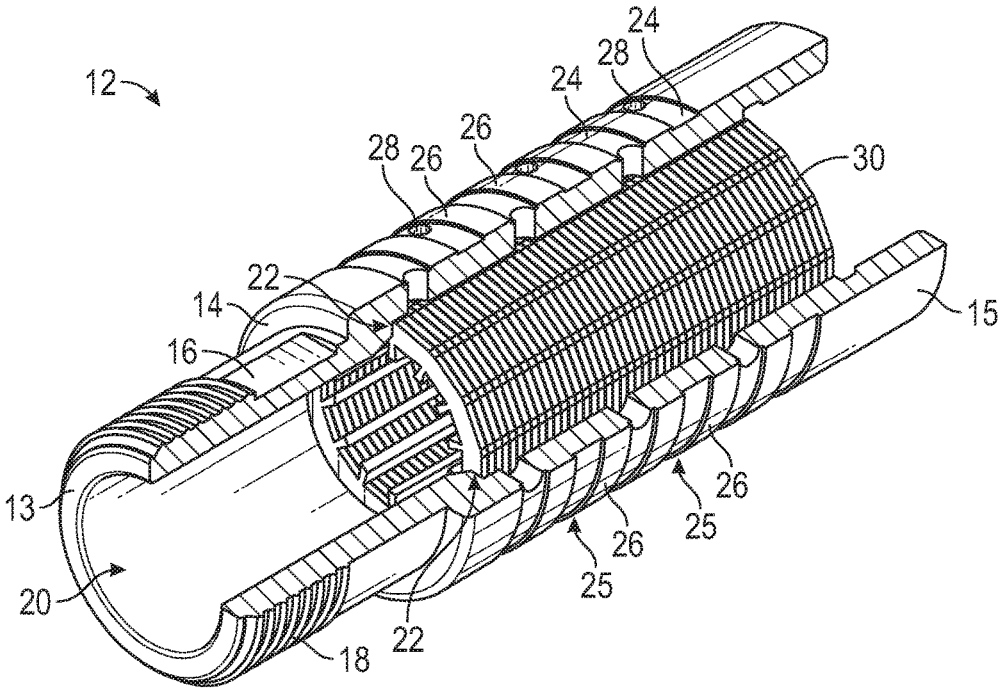
FIG. 8 is a perspective cut-away view of the upper screen housing of FIG. 4 shown with a screen positioned therein.

FIG. 8 is a cross-section of the upper screen housing 12 showing a screen 30 positioned therein. The top portion 13 of the upper screen housing 12 may have a narrower inner diameter than the body 14 of the upper screen housing 12, thereby creating an interior annular flange 22 at the interior junction between the top portion 13 and the body 14 of the upper screen housing 12. This interior annular flange 22 helps to hold the screen 30 in place within the body 14 of the upper screen housing 12. The outer diameter of the screen 30 is slightly smaller than the inner diameter of the body 14 of the upper screen housing 12. In one embodiment, the screen 30 (see FIG. 13) has a plurality of coils 32 with spaces 34 formed in between those coils 32. The coil 32 configuration forces the gas within the fluid toward the center of the fluid column, which allows higher density fluid to be available for fluid transfer through the screen 30 and then through the apertures 28 as clean fluid. In one embodiment, the spaces 34 between the coils 32 may be approximately 0.004-0.005 inch wide. However, the width of the spaces 34 between the coils 32 may vary, depending on the size and type of solids that are present in the particular well. For example, the width of the spaces 34 between the coils 32 may range from 0.0005-0.02 inch. However, it should be clearly understood that substantial benefit could be derived from a screen 30 wherein the spaces 34 between the coils 32 deviate from these dimensions, even substantially, in either direction. Screens 30 having spaces 34 of various dimensions may be interchanged in the upper screen housing 12, to accommodate various applications and well conditions that may be present. While in this embodiment the screen 30 includes coils 32, it should be clearly understood that substantial benefit could be derived from a screen 30 lacking coils 32 but having spaces/openings to allow fluid to flow therethrough. Preferably, the spaces/openings in the screen 30 are sized less than the plunger tolerance (i.e. the tolerance between the pump barrel inside diameter and plunger outside diameter). Typically, the plunger tolerance may range from 0.002-0.01 inch; however, it should be clearly understood that the plunger tolerance may deviate from this range. The screen 30 may be comprised of various sizes and configurations, depending on the configurations and conditions of the well in which it is employed. Further, the screen 30 may be comprised of various filter media or filtering components that may be suited to various configurations and conditions of the well in which it is employed. Such filter media may include, for example, metal, mesh material, woven material, sintered material, stainless steel, nylon, wire, or any other suitable filter medium. The screen 30 may have a polygonal shape, wherein the outer surface of the screen 30 has multiple straight edges. The polygon shape of the screen 30 allows fluid to accumulate in the area between the screen 30 and the interior surface of the body 14 of the upper screen housing 12, allowing the flow to pass into the apertures 28. If the screen 30 were circular, there would be no space between the outer surface of the screen 30 and the interior surface of the body 14 for fluid to pass; i.e. the apertures 28 would be blocked by the outer surface of the screen 30 if the screen 30 were circular. The open area created by the polygon shape of the screen 30 allows equalization of the fluid to evenly pass into the apertures 28 that has open tolerance between the pump barrel and the apertures 28. In an alternative embodiment, the screen 30 could be circular and simply be made smaller so that it would have a smaller outer diameter, thereby creating the space between the outer surface of the screen 30 and the interior surface of the body 14; however, this would be less efficient because such a smaller screen 30 would limit the amount of fluid that can flow through the upper screen housing 12. The screen 30 may have a plurality of veins 36 formed on the interior surface of the screen 30, which may extend along the full length of the screen 30. As shown, the veins 36 may have a triangular shape. This triangle shape allows for more area flow and less restriction in the flow path of the fluid. Screens 30 having various sizes and configurations and composed of various filter media may be interchanged in the upper screen housing 12, to accommodate various applications and well conditions that may be present.

Figure 9:
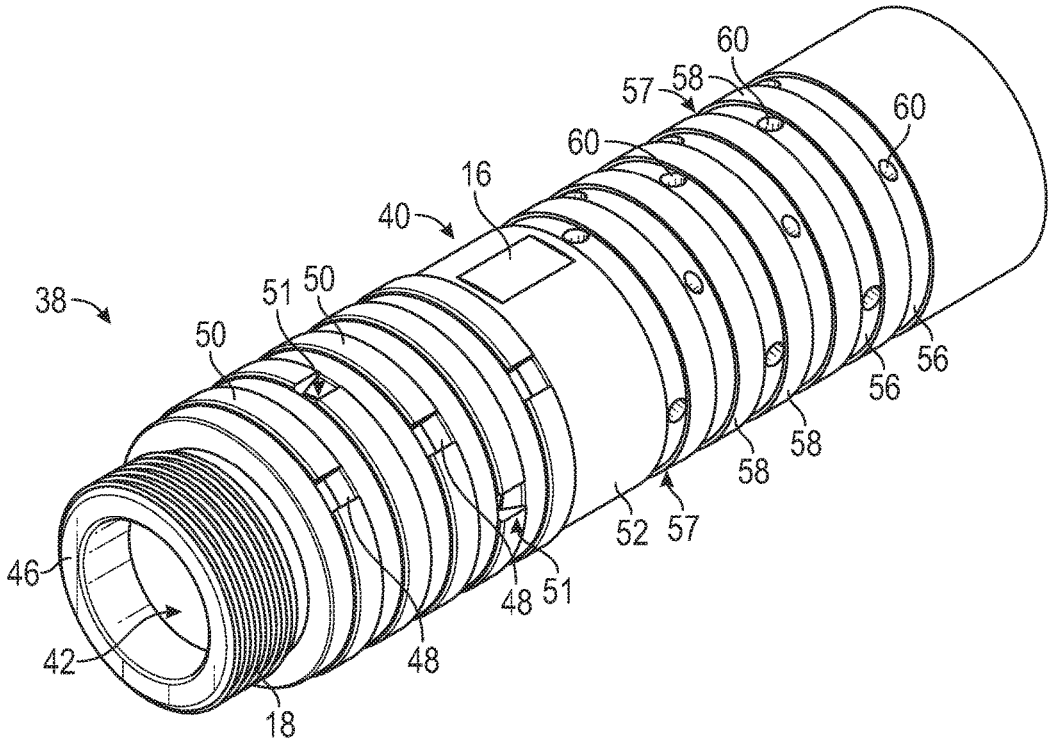
FIG. 9 is a perspective view of a lower screen housing portion of the screen filter assembly of FIG. 1.
Figure 10:
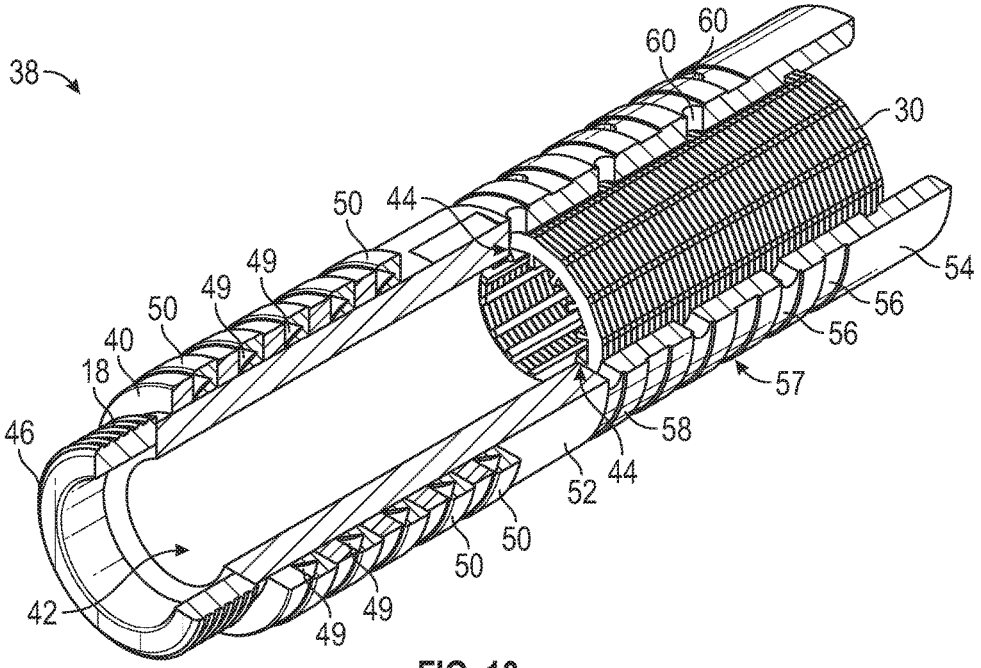
FIG. 10 is a perspective cut-away view of the lower screen housing of FIG. 9 shown with a screen positioned therein.
Figure 11:
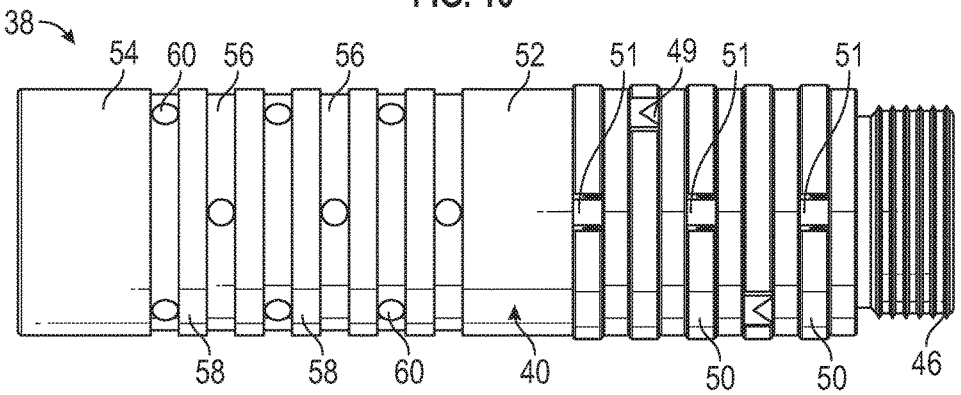
FIG. 11 is a side view of the lower screen housing of FIG. 9.

FIGS. 9-11 show the lower screen housing 38 of screen filter assembly 10. The lower screen housing 38 is cylindrical and has a top portion 46, a body 40, a middle portion 52, a bottom portion 54, and a center channel 42 formed completely therethrough. The middle portion 52 of the lower screen housing 38 may have wrench flats 16 formed thereon. The top portion 46 may have threading 18 to couple the lower screen housing 38 to the southern end of the upper screen housing 12 and the bottom portion 54 may have threading 18 to couple the lower screen housing 38 to the northern end of an adapter 64. The threading 18 may be male or female threading 18, as long as it engages the corresponding male or female threading present on a southern end of the upper screen housing 12 and the northern end of the adapter 64.

Figure 12:
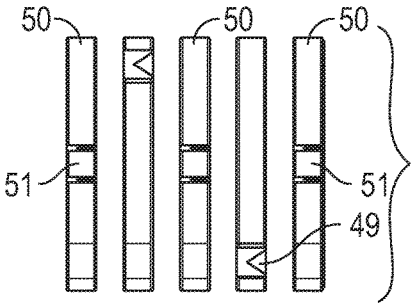
FIG. 12 is a side view of the plurality of rings of the lower screen housing, shown removed from the circular grooves of the top portion of the lower screen housing.
Figure 13:
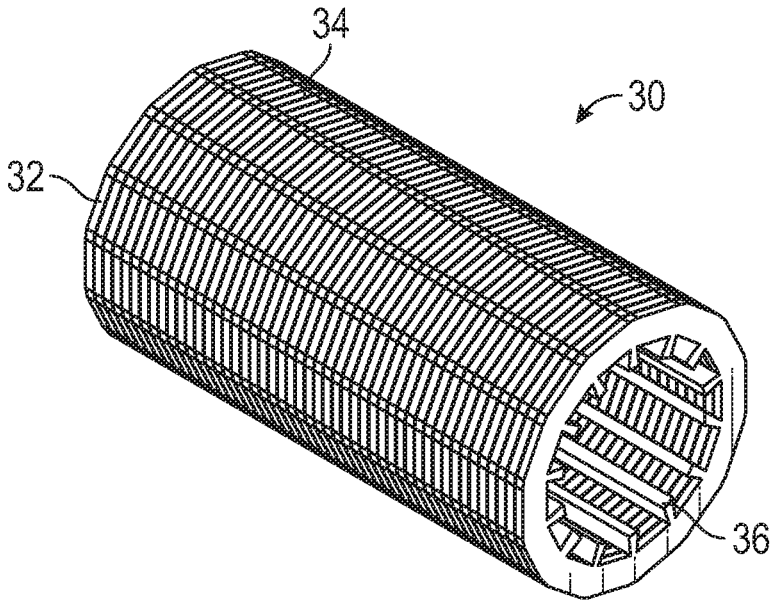
FIG. 13 is a perspective view of an embodiment of a screen that may be used in the upper screen housing, the lower screen housing, or a plunger, in accordance with one or more aspects of the present invention.

The top portion 46 of the lower screen housing 38 may have a plurality of circular grooves 48 formed on its outer surface. Although the top portion 46 of the lower screen housing 38 is shown as having five circular grooves 48, it should be clearly understood that any suitable number of circular grooves 48 may be used. The lower screen housing 38 also has a plurality of rings 50 coupled to its outer surface. The rings 50 are configured to fit within the corresponding circular grooves 48. The rings 50 are cut and have a smaller inner diameter than the outer diameter of the circular grooves 48 so that when the rings 50 are placed within the circular grooves 48, there is a small gap 51 between the cut ends of each ring 50. Referring to FIG. 12, the top surface of each ring 50 is not flat; rather, the top surface defines a channel 49. As the screen filter assembly 10 travels upwardly during an upstroke, fluid becomes caught within the channels 49 of the top surfaces of the rings 50. The pressure of the fluid causes the rings 50 to expand outwardly; i.e. the cut ends of each ring 50 separate from each other. This opening/expanding of the rings 50 outwardly against the barrel helps to prevent contaminated solids from falling downward toward the plunger 76. As also shown in FIGS. 9-12, the gaps 51 of the rings 50 are staggered. By having the gaps 51 staggered, any solids that might travel downwardly past the gap 51 of one ring 50 would be caught within the channel 49 of the ring 50 below it.

The bottom portion 54 of the lower screen housing 38 may have a plurality of circular flanges 58 and a plurality of circular grooves 56 formed on its outer surface. Although the bottom portion 54 of the lower screen housing 38 is shown as having five circular flanges 58 and six circular grooves 56, it should be clearly understood that any suitable number of circular flanges 26 and grooves 24 may be used. The circular grooves 56 are formed by and are thus positioned between the circular flanges 58. Each circular flange 58 may have a top edge 57 that may be angled downwardly and inwardly toward the center channel 42 of the lower screen housing 38. This downward and inward angle creates a "pocket" or dip that collects solids that are expelled from the center channel 42 of the lower screen housing 38 and out through the apertures 60 formed within the grooves 56. This helps to keep the solids away from the pump barrel. The outer surface of the bottom portion 54 may be slightly tapered so that the outer diameters of the circular flanges 58 steadily increase (e.g. by about 0.01 inch) when going from top to bottom. In order words, the circular flange 58 closest to the middle portion 52 of the lower screen housing 38 will have the smallest outer diameter and the circular flange 58 closest to the southern end of the bottom portion 54 of the lower screen housing 38 will have the largest outer diameter.

Each circular groove 56 on the bottom portion 54 of the lower screen housing 38 may have a plurality of apertures 60 formed therein. The apertures 60 pass through the bottom portion 54 of the lower screen housing 38 and are in fluid communication with the center channel 42 of the lower screen housing 38. Each circular groove 56 can have virtually any number of apertures 60, as can be desired for various well configurations and conditions. In one embodiment, the apertures 60 are evenly spaced around the circular groove 56 on the bottom portion 54 of the lower screen housing 38. Similar to the apertures 28 of the upper screen housing 12 shown in FIG. 6-7, the lower screen housing 38 also has apertures 60 that are angled in a direction that is diagonal to or off-centered from the center channel 42. This allows cyclonic rotation of the fluid and solids that are expelled from the apertures 60 so that they are expelled at an angle and constantly rotated around the lower screen housing 38, thereby preventing the solids from contacting the pump barrel and preventing the solids from accumulating in one particular spot on the top edges 57 of the circular flanges 58

Figure 14:
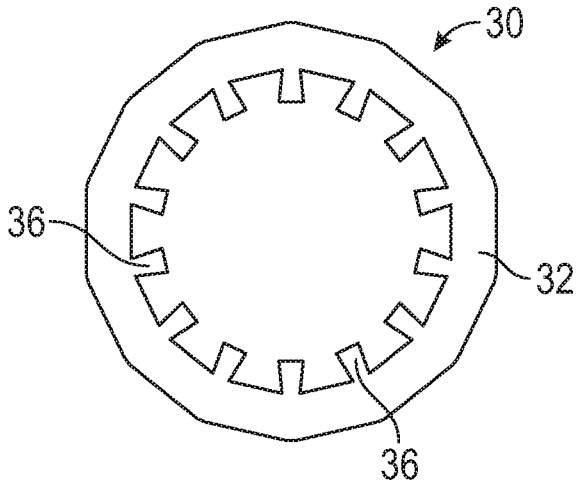
FIG. 14 is a bottom view of the screen of FIG. 13.

Similar to the apertures 28 of the upper screen housing 12, the apertures 60 formed in one circular groove 56 of the lower screen housing 12 may be staggered with the apertures 60 of the circular groove 56 above and/or below it. FIG. 10 is a cross-section of the lower screen housing 38 showing a screen 30 positioned therein. The middle portion 52 of the lower screen housing 38 may have a narrower inner diameter than the bottom portion 54 of the lower screen housing 38, thereby creating an interior annular flange 44 at the interior junction between the middle portion 52 and the bottom portion 54 of the lower screen housing 38. This interior annular flange 44 helps to hold the screen 30 in place within the bottom portion 54 of the lower screen housing 38. Similar to the screen 30 of the upper screen housing 12, the outer diameter of the screen 30 is slightly smaller than the inner diameter of the bottom portion 54 of the lower screen housing 38. In one embodiment, the screen 30 (see FIG. 13) has a plurality of coils 32 with spaces 34 formed in between those coils 32. The coil 32 configuration forces the gas within the fluid toward the center of the fluid column, which allows higher density fluid to be available for fluid transfer through the screen 30 and then through the apertures 60 as clean fluid. In one embodiment, the spaces 34 between the coils 32 may be approximately 0.004-0.005 inch wide. However, the width of the spaces 34 between the coils 32 may vary, depending on the size and type of solids that are present in the particular well. For example, the width of the spaces 34 between the coils 32 may range from 0.0005-0.02 inch. However, it should be clearly understood that substantial benefit could be derived from a screen 30 wherein the spaces 34 between the coils 32 deviate from these dimensions, even substantially, in either direction. Screens 30 having spaces 34 of various dimensions may be interchanged in the lower screen housing 38, to accommodate various applications and well conditions that may be present. While in this embodiment the screen 30 includes coils 32, it should be clearly understood that substantial benefit could be derived from a screen 30 lacking coils 32 but having spaces/openings to allow fluid to flow therethrough. Preferably, the spaces/openings in the screen 30 are sized less than the plunger tolerance (i.e. the tolerance between the pump barrel inside diameter and plunger outside diameter). Typically, the plunger tolerance may range from 0.002-0.01 inch; however, it should be clearly understood that the plunger tolerance may deviate from this range. The screen 30 may be comprised of various sizes and configurations, depending on the configurations and conditions of the well in which it is employed. Further, the screen 30 may be comprised of various filter media or filtering components that may be suited to various configurations and conditions of the well in which it is employed. Such filter media may include, for example, metal, mesh material, woven material, sintered material, stainless steel, nylon, wire, or any other suitable filter medium. The screen 30 of the lower screen housing 38 may also have a polygonal shape, wherein the outer surface of the screen 30 has multiple straight edges. The polygon shape of the screen 30 allows fluid to accumulate in the area between the screen 30 and the interior surface of the bottom portion 54 of the lower screen housing 38, allowing the flow to pass into the apertures 60. If the screen 30 were circular, there would be no space between the outer surface of the screen 30 and the interior surface of the bottom portion 54 for fluid to pass; i.e. the apertures 60 would be blocked by the outer surface of the screen 30 if the screen 30 were circular. The open area created by the polygon shape of the screen 30 allows equalization of the fluid to evenly pass into the apertures 28 that has open tolerance between the pump barrel and the apertures 60. The screen 30 of the lower screen housing 38 may also have a plurality of veins 36 formed on the interior surface of the screen 30, which may extend along the full length of the screen 30. As shown in FIG. 14, the veins 36 may have a triangular shape. This triangle shape allows for more area flow and less restriction in the flow path of the fluid. Screens 30 having various sizes and configurations and composed of various filter media may be interchanged in the lower screen housing 38, to accommodate various applications and well conditions that may be present.

Figure 15:
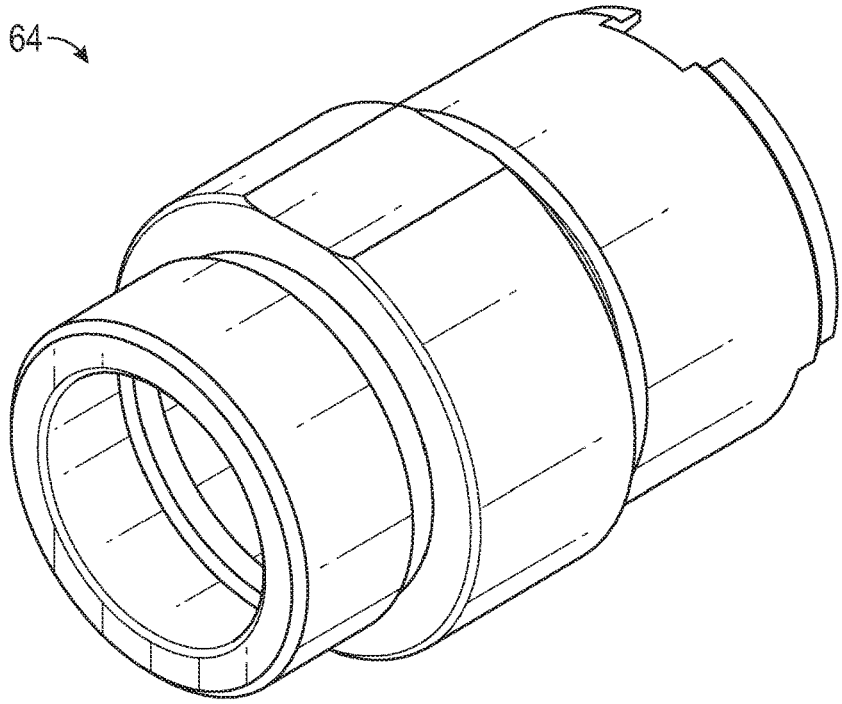
FIG. 15 is a perspective view of an adapter for coupling the screen filter assembly of FIG. 1 to a plunger.
Figure 16:
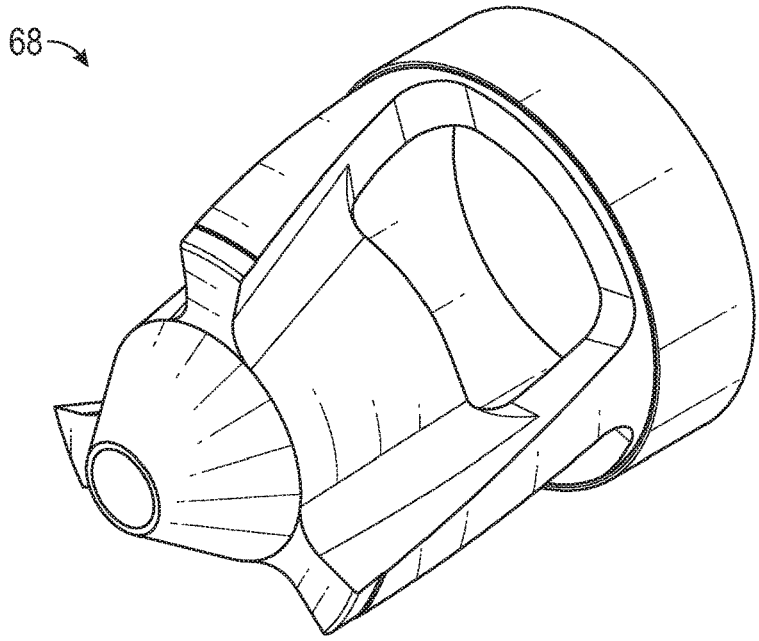
FIG. 16 is a perspective view of an insert portion of a ball valve.
Figure 17:
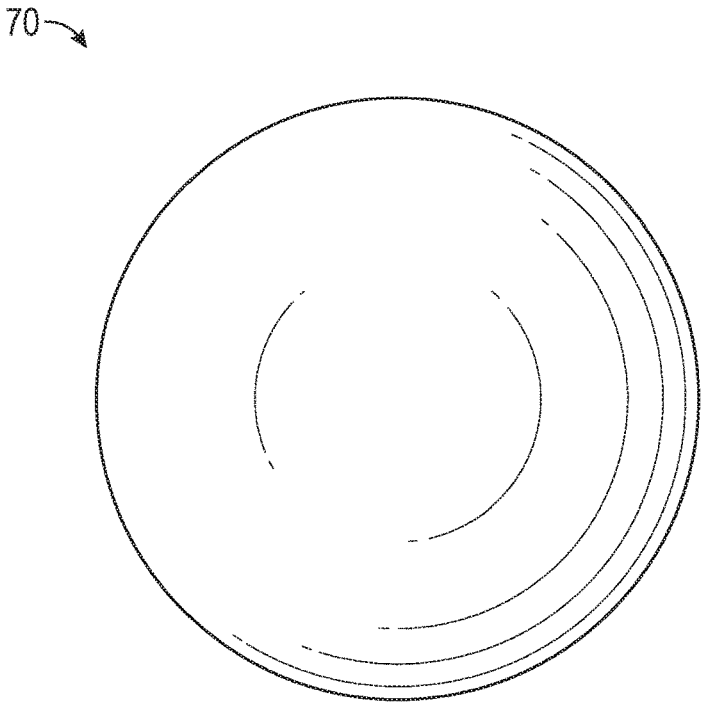
FIG. 17 is a perspective view of a ball portion of a ball valve.
Figure 18:
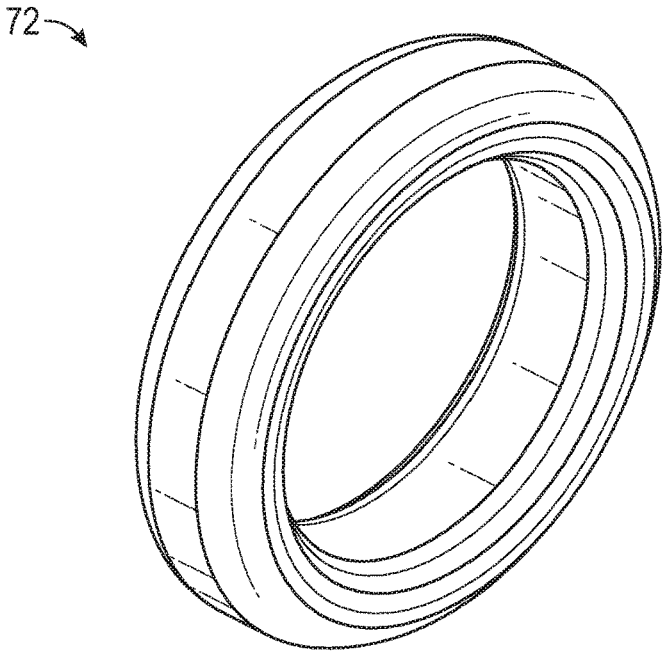
FIG. 18 is a perspective view of a seat portion of a ball valve.
Figure 19:
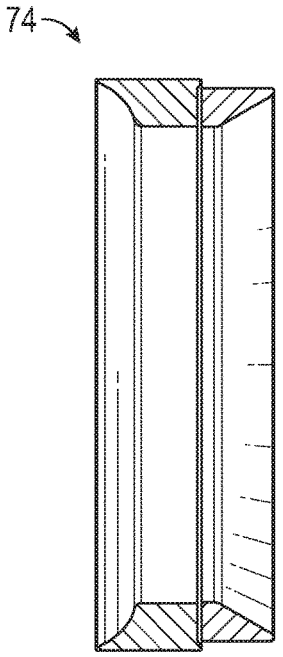
FIG. 19 is a side view of a press-fit seat plug of a plunger.
Figure 20:
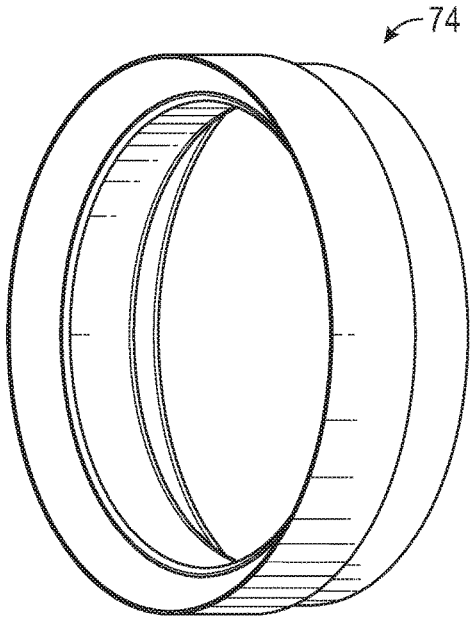
FIG. 20 is a perspective view of the press-fit seat plug of FIG. 19.
Figure 21:
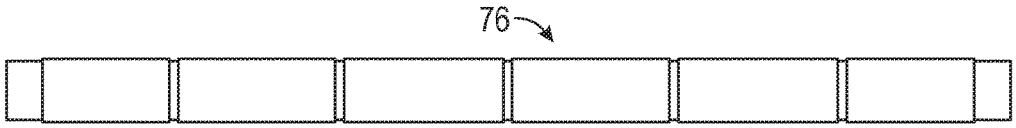
FIG. 21 is a side view of the plunger.
Figure 22:
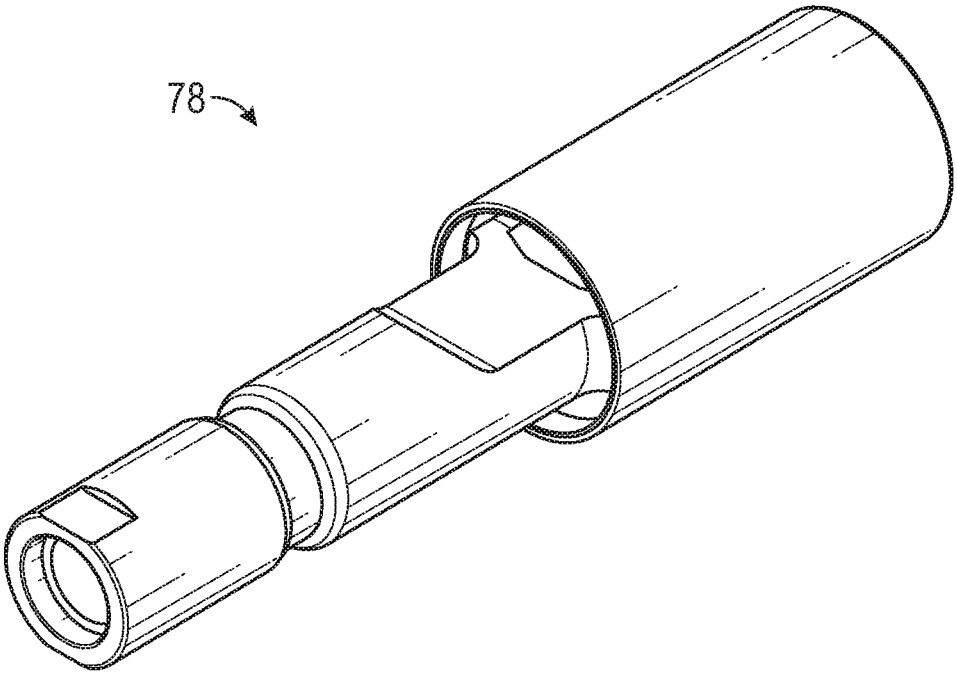
FIG. 22 is a perspective view of a traveling valve assembly.

FIG. 15 shows an adapter 64 for the screen filter assembly 10. The adapter may be used to couple the southern end of the screen filter assembly 10 to the north end of a plunger 76. FIGS. 16-18 together show the portions of a ball valve 66 that may be positioned at the northern end of the plunger 76; i.e. the helical insert 68, the ball 70, and the seat 72. FIGS. 19-20 show the press fit seat plug 74 that would be positioned between the seat 72 of the ball valve 66 and the northern end of the plunger 76. FIG. 21 shows the plunger 76 and FIG. 22 shows the traveling valve 78 that may be coupled to the southern end of the plunger 76. In some embodiments, the ball valve 66 may not be used and the screen filter assembly 10 may be coupled directly to the plunger 76. While, in this embodiment, the plunger 76 is depicted as a grooved plunger 76, it should be clearly understood that the plunger 76 may be non-grooved.

Figure 23:
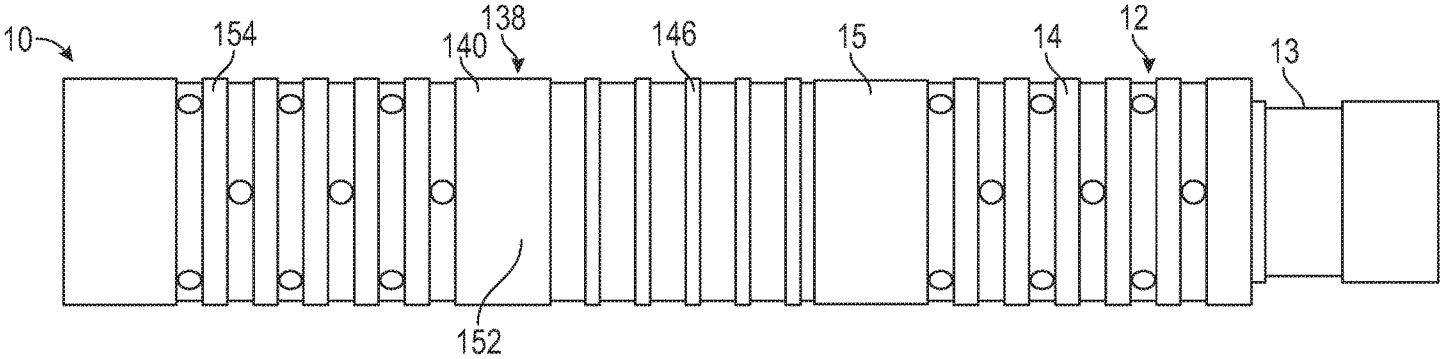
FIG. 23 is a side view of another embodiment of a screen filter assembly in accordance with one or more aspects of the present invention.
Figure 24:
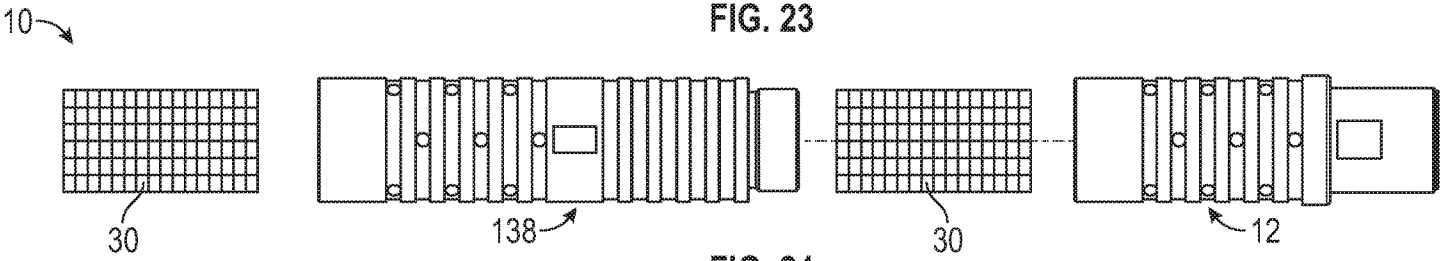
FIG. 24 is a side exploded view of the screen filter assembly of FIG. 23.
Figure 25:
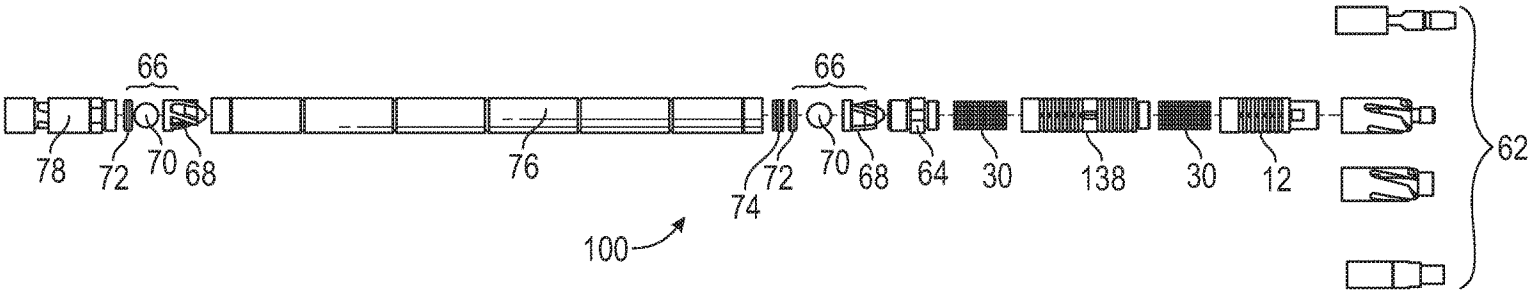
FIG. 25 is a side exploded view of the screen filter assembly of FIG. 23, wherein the screen filter assembly is shown coupled at its north end to a top plunger adapter and coupled at its south end to a plunger.
Figure 26:
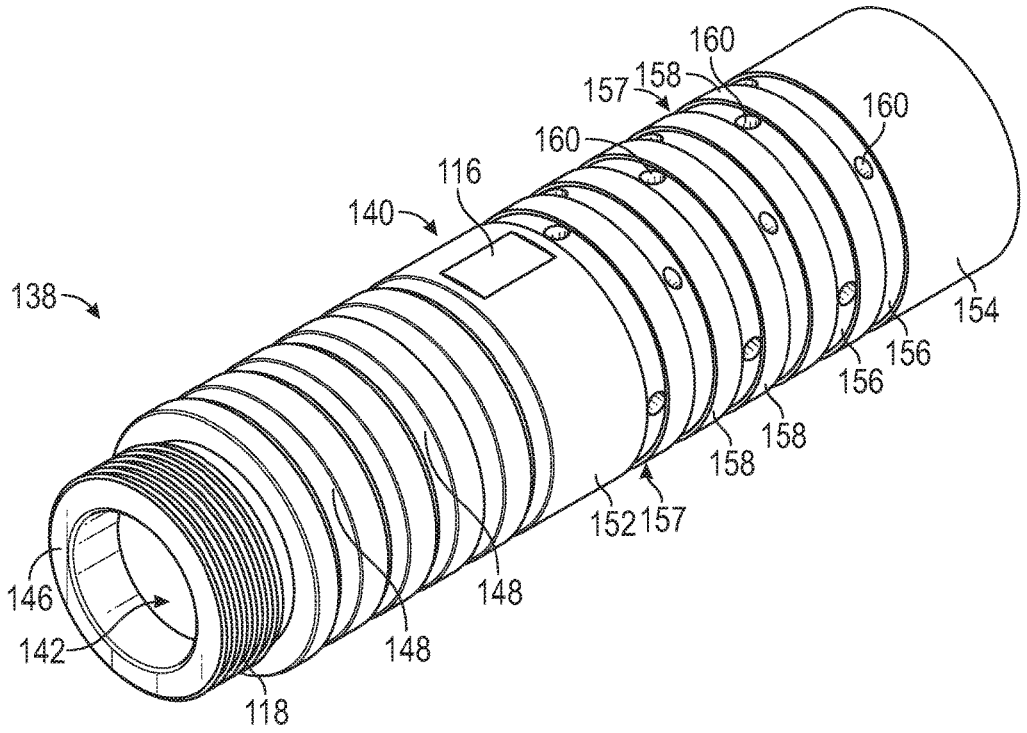
FIG. 26 is a perspective view of a lower screen housing portion of the screen filter assembly of FIG. 23.
Figure 27:
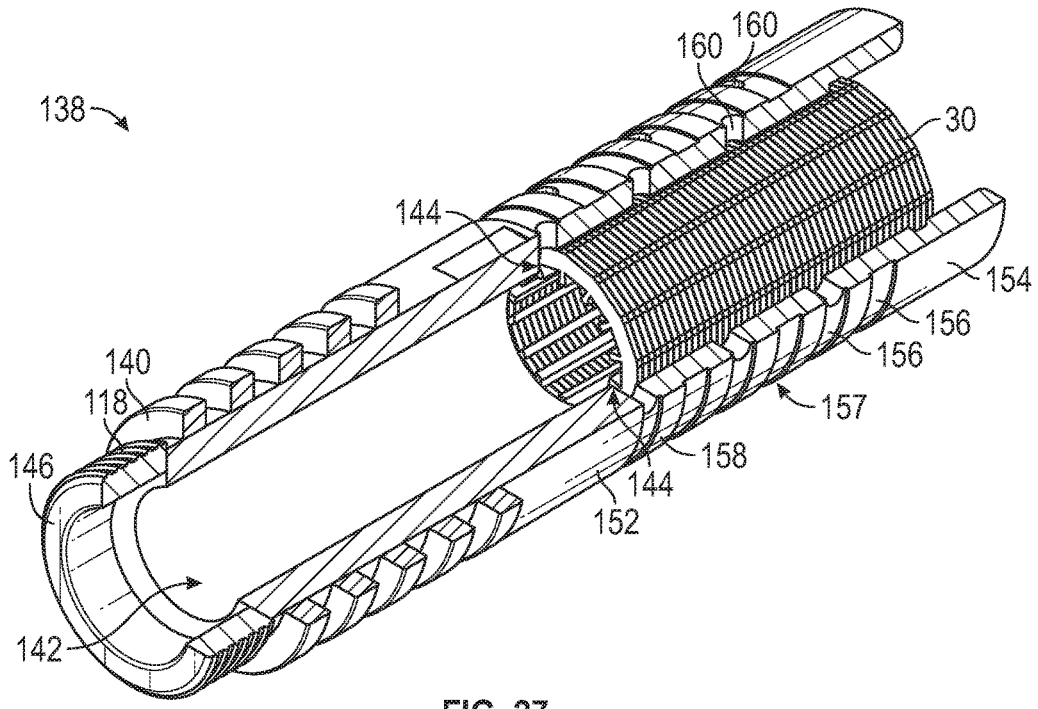
FIG. 27 is a perspective cut-away view of the lower screen housing of FIG. 26 shown with a screen positioned therein.
Figure 28:
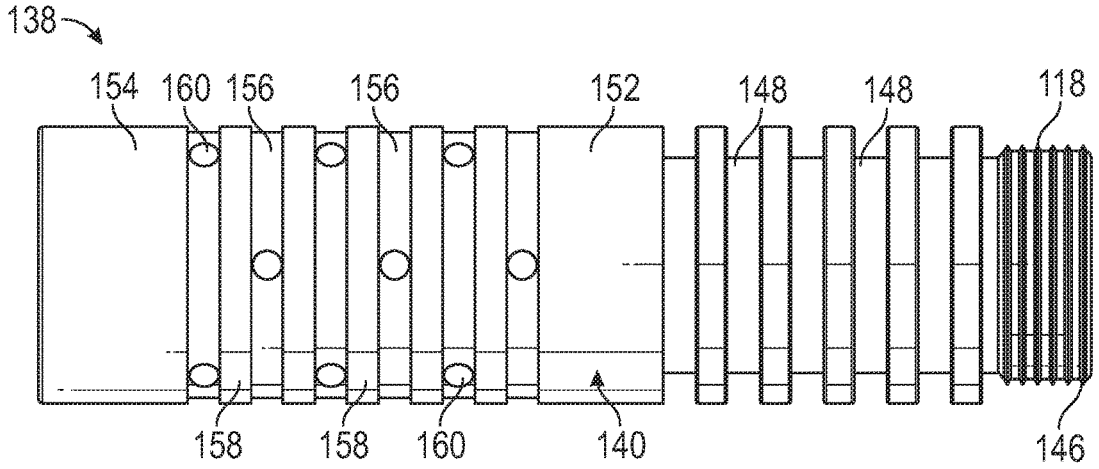
FIG. 28 is a side view of the lower screen housing of FIG. 26.

FIGS. 26-28 show another embodiment of the lower screen housing 138 (referred to generically as lower screen housing 38) of the screen filter assembly 10. As can be seen in FIGS. 23-25, the lower screen housing 138 may be substituted for lower screen housing 38 of the screen filter assembly 10. The lower screen housing 138 is similar to the lower screen housing 38, but lacks the plurality of rings 50. This embodiment of the lower screen housing 138 can be particularly suited for well conditions where solids having relatively greater dimensions are present (e.g. frac sand and the like). (Conversely, in well conditions where solids having relatively lesser dimensions are present (e.g. fine, powder-like solids and the like), the lower screen housing 38 can be particularly useful.) The lower screen housing 138 is cylindrical and has a top portion 146, a body 140, a middle portion 152, a bottom portion 154, and a center channel 142 formed completely therethrough. The middle portion 152 of the lower screen housing 138 may have wrench flats 116 formed thereon. The top portion 146 may have threading 118 to couple the lower screen housing 138 to the southern end of the upper screen housing 12 and the bottom portion 154 may have threading 118 to couple the lower screen housing 138 to the northern end of the adapter 64. The threading 118 may be male or female threading 118, as long as it engages the corresponding male or female threading present on a southern end of the upper screen housing 12 and the northern end of the adapter 64.

The top portion 146 of the lower screen housing 138 may have a plurality of circular grooves 148 formed on its outer surface. Although the top portion 146 of the lower screen housing 138 is shown as having five circular grooves 148, it should be clearly understood that any suitable number of circular grooves 148 may be used. As the screen filter assembly 10 travels upwardly during an upstroke, fluid entrained with solids becomes caught within the circular grooves 148, thereby trapping the solids. With the circular grooves 148 trapping the solids in this manner, this helps to prevent the solids from falling downward toward the plunger 76. Further, since there are multiple circular grooves 148, any solids that might travel downwardly past one circular groove 148 may be caught within the next circular groove 148 below it.

The bottom portion 154 of the lower screen housing 138 may have a plurality of circular flanges 158 and a plurality of circular grooves 156 formed on its outer surface. Although the bottom portion 154 of the lower screen housing 138 is shown as having five circular flanges 158 and six circular grooves 156, it should be clearly understood that any suitable number of circular flanges 158 and circular grooves 156 may be used. The circular grooves 156 are formed by and are thus positioned between the circular flanges 158. Each circular flange 158 may have a top edge 157 that may be angled downwardly and inwardly toward the center channel 142 of the lower screen housing 138. This downward and inward angle creates a "pocket" or dip that collects solids that are expelled from the center channel 142 of the lower screen housing 138 and out through apertures 160 formed within the circular grooves 156. This helps to keep the solids away from the pump barrel. The outer surface of the bottom portion 154 may be slightly tapered so that the outer diameters of the circular flanges 158 steadily increase (e.g. by about 0.01 inch) when going from top to bottom. In order words, the circular flange 158 closest to the middle portion 152 of the lower screen housing 138 will have the smallest outer diameter and the circular flange 158 closest to the southern end of the bottom portion 154 of the lower screen housing 138 will have the largest outer diameter.

Each circular groove 156 on the bottom portion 154 of the lower screen housing 138 may have a plurality of apertures 160 formed therein. The apertures 160 pass through the bottom portion 154 of the lower screen housing 138 and are in fluid communication with the center channel 142 of the lower screen housing 138. Each circular groove 156 can have virtually any number of apertures 160, as can be desired for various well configurations and conditions. In one embodiment, the apertures 160 are evenly spiced around the circular grooves 156 on the bottom portion 154 of the lower screen housing 138. The apertures 160 are angled in a direction that is diagonal to or off-centered from the center channel 142. This allows cyclonic rotation of the fluid and solids that are expelled from the apertures 160 so that they are expelled at an angle and constantly rotated around the lower screen housing 138, thereby preventing the solids from contacting the pump barrel and preventing the solids from accumulating in one particular spot on the top edges 157 of the circular flanges 158.

The apertures 160 formed in one circular groove 156 of the lower screen housing 138 may be staggered with the apertures 160 of the circular groove 156 above and/or below it. FIG. 27 is a cross-section of the lower screen housing 138 showing the screen 30 positioned therein. The middle portion 152 of the lower screen housing 138 may have a narrower inner diameter than the bottom portion 154 of the lower screen housing 138, thereby creating an interior annular flange 144 at the interior junction between the middle portion 152 and the bottom portion 154 of the lower screen housing 138. This interior annular flange 144 helps to hold the screen 30 in place within the bottom portion 154 of the lower screen housing 138. The outer diameter of the screen 30 is slightly smaller than the inner diameter of the bottom portion 154 of the lower screen housing 138. In one embodiment, the screen 30 (see FIG. 13) has a plurality of coils 32 with spaces 34 formed in between those coils 32. The coil 32 configuration forces the gas within the fluid toward the center of the fluid column, which allows higher density fluid to be available for fluid transfer through the screen 30 and then through the apertures 160 as clean fluid. In one embodiment, the spaces 34 between the coils 32 may be approximately 0.004-0.005 inch wide. However, the width of the spaces 34 between the coils 32 may vary, depending on the size and type of solids that are present in the particular well. For example, the width of the spaces 34 between the coils 32 may range from 0.0005-0.02 inch. However, it should be clearly understood that substantial benefit could be derived from a screen 30 wherein the spaces 34 between the coils 32 deviate from these dimensions, even substantially, in either direction. While in this embodiment the screen 30 includes coils 32, it should be clearly understood that substantial benefit could be derived from a screen 30 lacking coils 32 but having spaces/openings to allow fluid to flow therethrough. Preferably, the spaces/openings in the screen 30 are sized less than the plunger tolerance (i.e. the tolerance between the pump barrel inside diameter and plunger outside diameter). Typically, the plunger tolerance may range from 0.002-0.01 inch; however, it should be clearly understood that the plunger tolerance may deviate from this range. The screen 30 may be comprised of various sizes and configurations, depending on the configurations and conditions of the well in which it is employed. Further, the screen 30 may be comprised of various filter media or filtering components that may be suited to various configurations and conditions of the well in which it is employed. Such filter media may include, for example, metal, mesh material, woven material, sintered material, stainless steel, nylon, wire, or any other suitable filter medium. The screen 30 of the lower screen housing 138 may also have a polygonal shape, wherein the outer surface of the screen 30 has multiple straight edges. The polygon shape of the screen 30 allows fluid to accumulate in the area between the screen 30 and the interior surface of the bottom portion 154 of the lower screen housing 138, allowing the flow to pass into the apertures 160. If the screen 30 were circular, there would be no space between the outer surface of the screen 30 and the interior surface of the bottom portion 154 for fluid to pass; i.e. the apertures 160 would be blocked by the outer surface of the screen 30 if the screen 30 were circular. The open area created by the polygon shape of the screen 30 allows equalization of the fluid to evenly pass into the apertures 160 that has open tolerance between the pump barrel and the apertures 160. The screen 30 of the lower screen housing 138 may also have a plurality of veins 36 formed on the interior surface of the screen 30, which may extend along the full length of the screen 30. As shown in FIG. 14, the veins 36 may have a triangular shape. This triangle shape allows for more area flow and less restriction in the flow path of the fluid. Screens 30 having various sizes and configurations and composed of various filter media may be interchanged in the lower screen housing 138, to accommodate various applications and well conditions that may be present.

Figure 29:
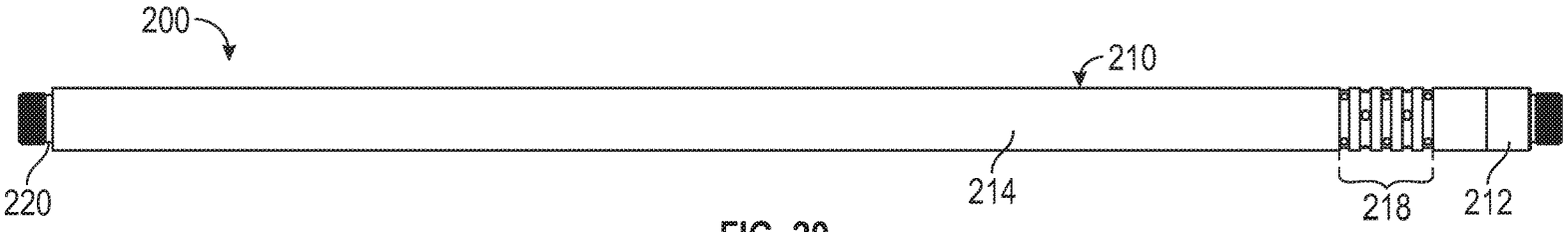
FIG. 29 is a side view of another embodiment of a screen filter assembly in accordance with one or more aspects of the present invention.
Figure 30:
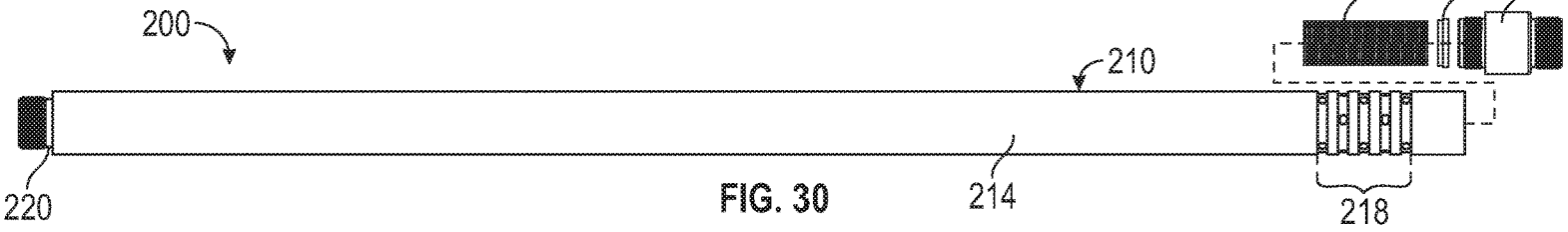
FIG. 30 is a side, exploded view of the screen filter assembly of FIG. 29.
Figure 31:
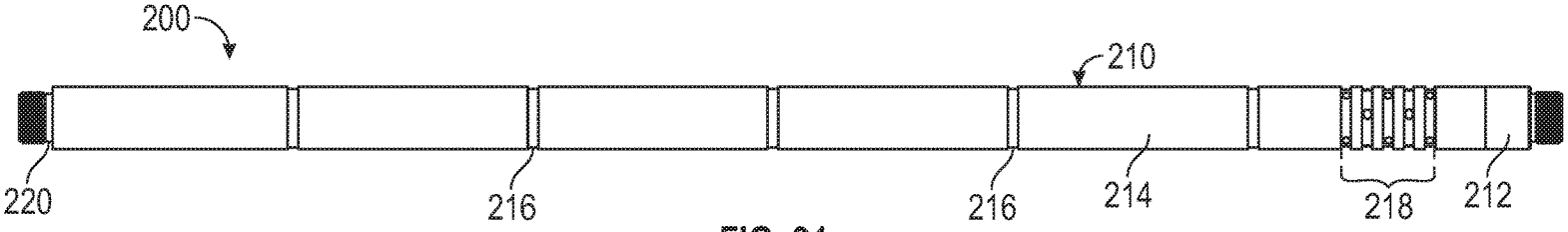
FIG. 31 is a side view of another embodiment of a screen filter assembly in accordance with one or more aspects of the present invention.
Figure 32:
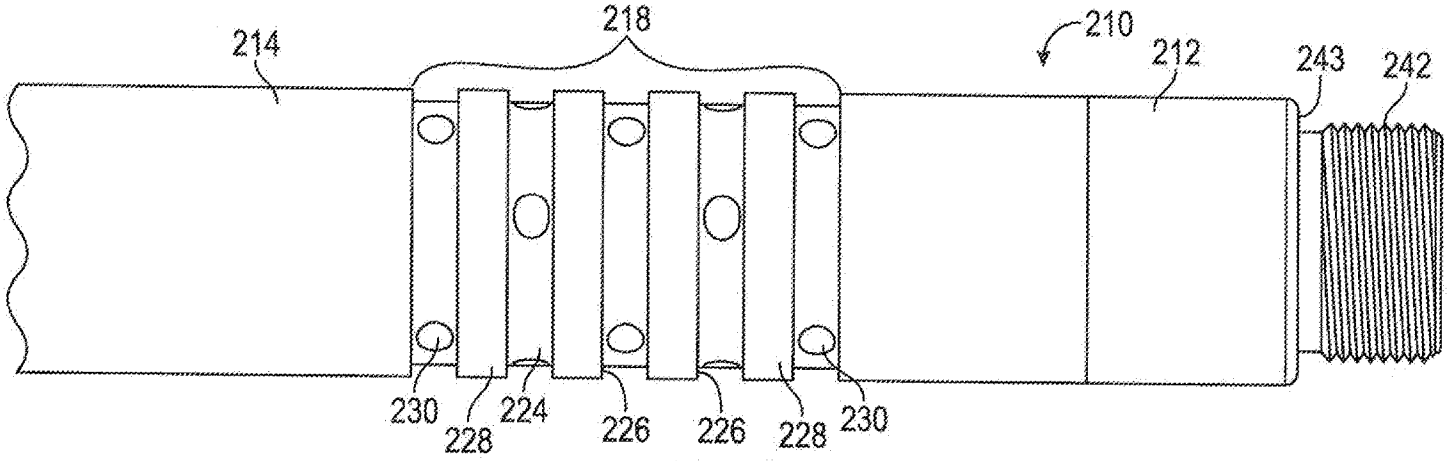
FIG. 32 is a side view of an upper portion of the screen filter assemblies of FIGS. 29 and 31.
Figure 33:
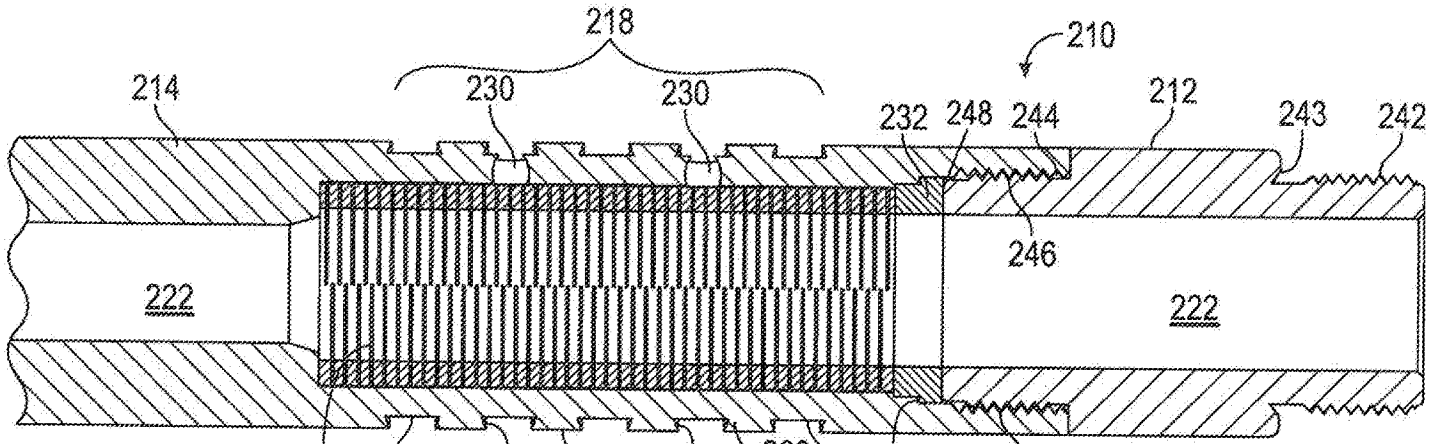
FIG. 33 is a side cross-sectional view of the upper portion of the screen filter assemblies shown in FIG. 32.

FIGS. 29-37, together, show another embodiment of a screen filter assembly, hereinafter screen filter assembly 200, of the present invention. In this embodiment, the screen filter assembly 200 is incorporated into a plunger 210. The screen filter assembly 200, with its plunger 210, may be interchanged with various standard plungers, such as plunger 76 shown in FIGS. 3 and 21, for example. When interchanging the screen filter assembly 200 with plunger 76, the screen filter assembly 200 may become part of the plunger assembly 100. The screen filter assembly 200 is adapted to be used with a pump system that is positioned within a pump barrel. While, in this embodiment, the screen filter assembly 200 is shown incorporated into a full-length plunger 210, it should be generally understood that substantial benefit could be derived from a screen filter assembly 200 that is incorporated into plungers of various lengths, as may be desired depending upon the particular configurations and conditions of the well in which it is employed. As shown in FIGS. 30 and 33, for example, the screen filter assembly 200 of the present invention may generally comprise a plunger 210 and a screen 30 positioned in the plunger 210.

FIGS. 29-33 show the plunger 210 of the screen filter assembly 200. Referring first to FIGS. 29-31, the plunger 210 will be described. The plunger 210 is cylindrical and has a top portion 212, a body 214, a bottom portion 220, and a center channel 222 formed completely therethrough (see, e.g., FIGS. 33 and 37). Referring next to FIG. 32, the body 214 of the plunger 210 may have a grooved region 218, wherein a plurality of circular flanges 228 and a plurality of circular grooves 224 may be formed on an outer surface of the body 214. Although the grooved region 218 is shown as having four circular flanges 228 and five circular grooves 224, it should be clearly understood that any suitable number of circular flanges 228 and circular grooves 224 may be used. The circular grooves 224 are formed by and are thus positioned between the circular flanges 228. Referring to FIGS. 32-33, each circular flange 228 may have a top edge 226 that may be angled downwardly and inwardly toward the center channel 222 of the plunger 210. This downward and inward angle creates a "pocket" or dip that collects solids that are expelled from the center channel 222 of the plunger 210 and out through a plurality of apertures 230 formed within the circular grooves 224. This helps to keep the solids away from the pump barrel. The grooved region 218 may be slightly tapered so that the outer diameters of the circular flanges 228 steadily increase (e.g. by about 0.01 inch) when going from top to bottom. In other words, the circular flange 228 closest to the top portion 212 of the plunger 210 will have the smallest outer diameter and the circular flange 228 closest to the bottom portion 220 of the plunger 210 will have the largest outer diameter. While the grooved region 218 is shown as being positioned on an upper portion of the body 214, it should be clearly understood that the grooved region 218 may be positioned in other areas of the body 214.

Figure 36:
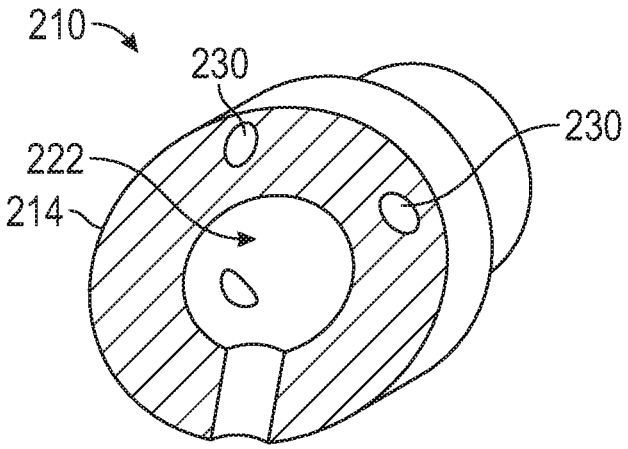
FIG. 36 is a bottom perspective cross-sectional view of an upper portion of a plunger of the screen filter assemblies of FIGS. 29 and 31.
Figure 37:
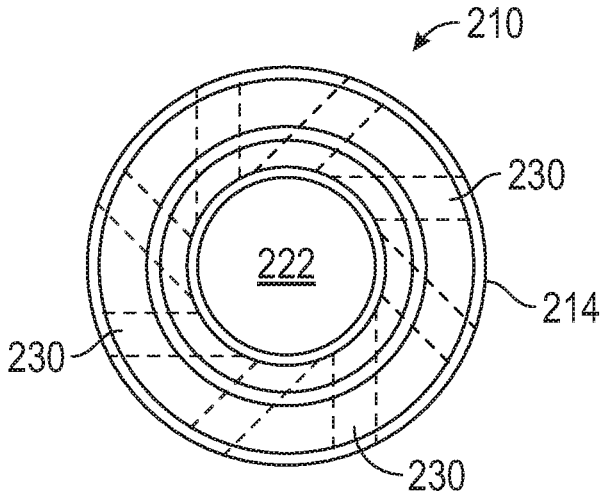
FIG. 37 is a cross-sectional bottom view of an upper portion of the plunger of the screen filter assemblies of FIGS. 29 and 31.

Each circular groove 224 may have a plurality of apertures 230 formed therein. The apertures 230 pass through the body 214 of the plunger 210 and are in fluid communication with the center channel 222 of the plunger 210. Each circular groove 224 can have virtually any number of apertures 230, as can be desired for various well configurations and conditions. In one embodiment, the apertures 230 are evenly spaced around the circular groove 224 on the body 214 of the plunger 210. Preferably, as shown in FIGS. 36-37, from the perspective of the exterior of the plunger 210, each aperture 230 may be angled in a direction that is diagonal to or off-centered from the center channel 222. If the apertures 230 were positioned perpendicularly to the center channel 222, the fluid and solids that are expelled from the apertures 230 would be expelled directly toward the pump barrel, which can cause damage to the pump. Therefore, it is preferable to have the apertures 230 positioned diagonally relative to the center channel 222 (i.e. off-centered) because this allows cyclonic rotation of the fluid and solids that are expelled from the apertures 230 so that they are expelled at an angle and constantly rotated around the plunger 210, thereby preventing the solids from contacting the pump barrel and preventing the solids from accumulating in one particular spot on the top edges 226 of the circular flanges 228.

As shown, the apertures 230 formed in one circular groove 224 may be staggered with the apertures 230 of the circular groove 224 above and/or below it. This aids in the collection and distribution of solids within the pockets or dips of the top edges 226 of the circular flanges 228. If all of the apertures 230 of all of the circular grooves 224 were aligned, this would cause the solids to accumulate in particular spots on the top edges 226 of the circular flanges 228 (in the areas directly below each line of apertures 230), which is not preferable.

Referring to FIG. 33, the body 214 may have threading 240 to couple a northern end of the body 214 to a southern end of the top portion 212 of the plunger 210. The threading 240 may be male or female threading 240, as long as it engages corresponding male or female threading 246 present on a southern end of the top portion 212 of the plunger 210. Still referring to FIG. 33, the body 214 may have an angled interlocking region 241. As seen in this embodiment, the interlocking region 241 may be formed within the interior diameter of the body 214 of the plunger 210. The interlocking region 241 is configured to mate with a corresponding interlocking region 238 of a retainer ring 232 when the retainer ring 232 is positioned within the body 214 of the plunger 210, as discussed herein.

In one embodiment, as shown in FIG. 31, the body 214 of the plunger 210 may have a plurality of circular grooves 216 formed on its outer surface along a length of the plunger 210. In this embodiment, the circular grooves 216 are shown as being equidistantly spaced-apart. However, it should be clearly understood that the circular grooves 216 may be spaced differently, depending upon the particular configurations and conditions of the well in which the plunger 210 is employed. Further, in this embodiment, the plunger 210 is shown as having five circular grooves 216. However, it should be clearly understood that any suitable number of circular grooves 216 may be used.

Figure 34:
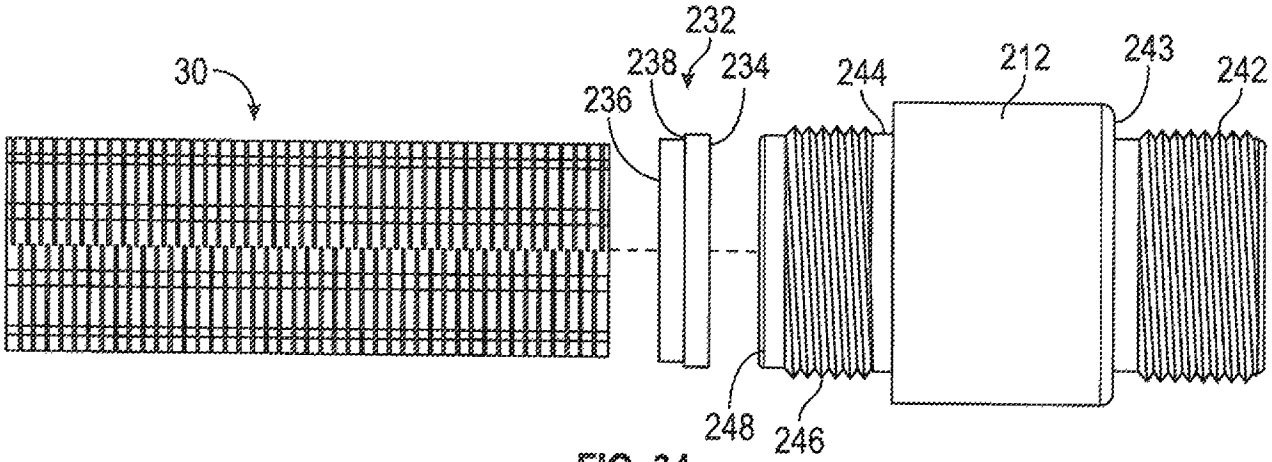
FIG. 34 is a side, exploded view of a top portion of a plunger, a retainer ring, and a screen of the screen filter assemblies of FIGS. 29 and 31.
Figure 35:
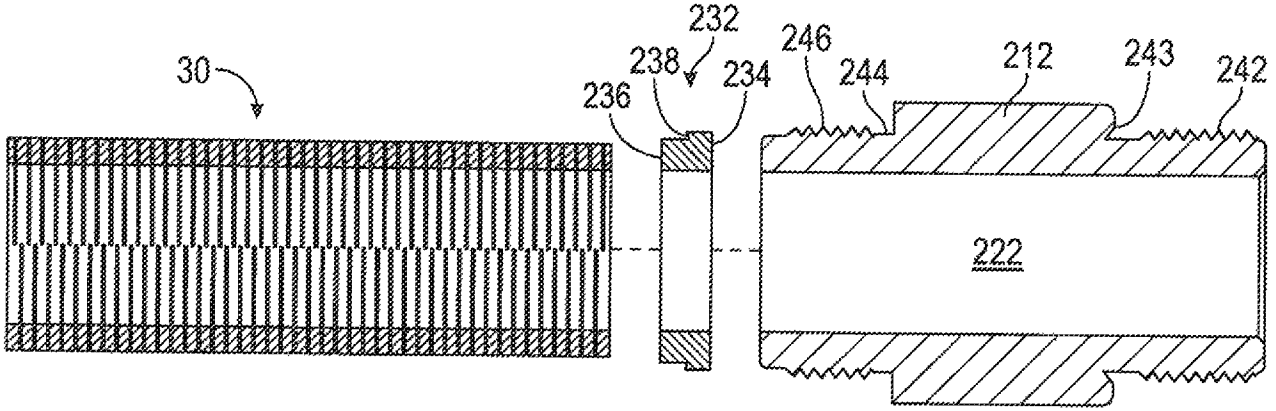
FIG. 35 is a side, cross-sectional, exploded view of the top portion of the plunger, the retainer ring, and the screen of the screen filter assemblies shown in FIG. 34.

Referring to FIGS. 33-35, the top portion 212 of the plunger 210 will be discussed. The top portion 212, as seen in this embodiment, may have threading 242 to couple a northern end of the top portion 212 of the plunger 210 to a variety of pump components, such as top plunger adapter 62, for example. The threading 242 may be male or female threading 242, as long as it engages the corresponding male or female threading present on the southern end of the various pump component to which it may be coupled. The top portion 212 may have a top edge 243 that may be angled downwardly and inwardly toward the center channel 222 of the plunger 210. This downward and inward angle creates a "pocket" or dip that collects solids as the plunger 210 moves upwardly. This helps to keep the solids from away from the area between the plunger 210 and pump barrel in this region. The top portion 212 may also have threading 246 to couple the top portion 212 to the body 214. The threading 246 may be male or female threading 246, as long as it engages the corresponding male or female threading 240 present on the northern end of the body 214. As seen in this embodiment, the top portion 212 may also have a thread masher/lock region 244. The thread masher/lock region 244 is adapted to receive the northern-most one to three threads of threading 240 when the body 214 and top portion 212 of the plunger 210 are coupled. Preferably, the thread masher/lock region 244 has a diameter that is 0.002 inch larger than a minor diameter of the northern portion of the body 214 with which the thread masher/lock region 244 mates. Referring to FIG. 34, the top portion 212 of the plunger 210 may also have an angled lip 248.

When coupling the top portion 212 to the body 214 of the plunger 210, the top portion 212 may be screwed into the body 214. When the top portion 212 is fully screwed into the body 214, the northern-most one to three threads of threading 240 are rolled into the thread masher/lock region 244. This damages the northern-most one to three threads of threading 240, which causes the top portion 212 and body 214 to be permanently joined without requiring the application of heat. This keeps the threading 240 and 246 locked in place. In this way, the thread masher/lock region 244 prevents the top portion 212 and body 214 from becoming loosened from one another. This is an advantage over typical prior art methods of joining threaded mating components, in which a paste containing bronze particles may be used to lock threads in place. With such prior art methods, the paste is applied to female threading and the mating components are then coupled. Once the mating components are coupled, heat is applied until the bronze particles in the paste melt. Once the heat is removed, the bronze solidifies, keeping the threads locked in place with bronze in between the threads. This and similar prior art methods can be complicated and expensive.

Once the screen filter assembly 200 is fully assembled, spray metal or the like may be applied to an area where the top portion 212 and body 214 of the plunger 210 meet, in order to further prevent the top portion 212 and body 214 from moving in any way and becoming detached from one another.

Referring to FIGS. 33-35, the screen filter assembly 200 may have a retainer ring 232 to hold the screen 30 in place within the plunger 210. In this embodiment, the retainer ring 232 is configured to fit within the body 214 of the plunger 210. As seen in this embodiment, the retainer ring 232 has a top edge 234, a bottom edge 236 and an angled interlocking region 238 juxtaposed between the top edge 234 and bottom edge 236. As shown in FIG. 33, the top edge 234 is configured to mate with the angled lip 248 of the top portion 212 of the plunger 210 when the top portion 212 and body 214 are coupled. The top edge 234 may have a corresponding angled lip for this purpose. The bottom edge 236 is configured to mate with a northern end of the screen 30. The interlocking region 238 is configured to mate with the corresponding interlocking region 241 of the body 214 of the plunger 210 when the retainer ring 232 is positioned within the plunger 210. When the retainer ring 232 is pressed into the interior diameter of the body 214 of the plunger 210, the interlocking region 238 engages with the interlocking region 241, thereby locking the retainer ring 232 in place. Once the retainer ring 232 is in place within the body 214 of the plunger 210, the screen 30 is held in place within the body 214 of the plunger 210. Further, with the retainer ring 232 locked in place, this creates a platform or base for the top portion 212 of the plunger 210. As a result, this prevents the top portion 212 from causing the retainer ring 232 to become mashed into the screen 30 when the top portion 212 is coupled to the body 214 of the plunger 210.

Referring now to FIG. 33, attention is directed to the screen 30. The outer diameter of the screen 30 is slightly smaller than the inner diameter of the body 214 of the plunger 210. In one embodiment, the screen 30 (see FIG. 13) has a plurality of coils 32 with spaces 34 formed in between those coils 32. The coil 32 configuration forces the gas within the fluid toward the center of the fluid column, which allows higher density fluid to be available for fluid transfer through the screen 30 and then through the apertures 230 as clean fluid. In one embodiment, the spaces 34 between the coils 32 may be approximately 0.004-0.005 inch wide. However, the width of the spaces 34 between the coils 32 may vary, depending on the size and type of solids that are present in the particular well. For example, the width of the spaces 34 between the coils 32 may range from 0.0005-0.02 inch. However, it should be clearly understood that substantial benefit could be derived from a screen 30 wherein the spaces 34 between the coils 32 deviate from these dimensions, even substantially, in either direction. Screens 30 having spaces 34 of various dimensions may be interchanged in the plunger 210, to accommodate various applications and well conditions that may be present. The screen 30 may have a polygonal shape, wherein the outer surface of the screen 30 has multiple straight edges. The polygon shape of the screen 30 allows fluid to accumulate in the area between the screen 30 and the interior surface of the body 214 of the plunger 210, allowing the flow to pass into the apertures 230. If the screen 30 were circular, there would be no space between the outer surface of the screen 30 and the interior surface of the body 214 for fluid to pass; i.e. the apertures 230 would be blocked by the outer surface of the screen 30 if the screen 30 were circular. The open area created by the polygon shape of the screen 30 allows equalization of the fluid to evenly pass into the apertures 230 that has open tolerance between the pump barrel and the apertures 230. In an alternative embodiment, the screen 30 could be circular and simply be made smaller so that it would have a smaller outer diameter, thereby creating the space between the outer surface of the screen 30 and the interior surface of the body 214; however, this would be less efficient because such a smaller screen 30 would limit the amount of fluid that can flow through the grooved region 218 of the plunger 210. The screen 30 may have a plurality of veins 36 formed on the interior surface of the screen 30, which may extend along the full length of the screen 30. As shown, the veins 36 may have a triangular shape. This triangle shape allows for more area flow and less restriction in the flow path of the fluid.

Statement of Operation

The screen filter assembly 10 of the present invention may be positioned below a top plunger adapter 62 and above a plunger 76. During a downstroke, dirty fluid enters through the center channel 42/142 at the bottom portion 54/154 of the lower screen housing 38/138 and the pressure of the downstroke pushes the dirty fluid outwardly toward the screen 30 within the lower screen housing 38/138. As the dirty fluid passes through the screen 30 of the lower screen housing 38/138, the screen 30 filters the solids from the dirty fluid by preventing any solids larger than the spaces 34 between each coil 32 from passing through the screen 30 toward the apertures 60 of the lower screen housing 38/138. (Similarly, in the case of an alternative embodiment of the screen 30 lacking coils 32 but having spaces/openings to allow fluid to flow therethrough, the screen 30 filters the solids from the dirty fluid by preventing any solids larger than the spaces/openings from passing through the screen 30 toward the apertures 60 of the lower screen housing 38/138.) The result is that clean fluid is evacuated through the apertures 60 of the lower screen housing 38/138. With respect to the lower screen housing 38, the plurality of rings 50 on the top portion 46 of the lower screen housing 38 help to prevent the clean fluid from traveling upwardly and mixing with dirty fluid above the rings 50 near the upper screen housing 12. Similarly, with respect to the lower screen housing 138, the plurality of circular grooves 148 on the top portion 46 of the lower screen housing 138 help to prevent the clean fluid from traveling upwardly and mixing with dirty fluid above the circular grooves 148 near the upper screen housing 12.

Dirty fluid continues to travel upwardly through the lower screen housing 38/138 and upwardly through the central channel 20 at the bottom portion 15 of the upper screen housing 12. The pressure of the downstroke pushes the dirty fluid outwardly toward the screen 30 within the upper screen housing 12. As the dirty fluid passes through the screen 30 of the upper screen housing 12, the screen 30 filters the solids from the dirty fluid by preventing any solids larger than the spaces 34 between each coil 32 from passing through the screen 30 toward the apertures 28 of the upper screen housing 12. (Similarly, in the case of an alternative embodiment of the screen 30 lacking coils 32 but having spaces/openings to allow fluid to flow therethrough, the screen 30 filters the solids from the dirty fluid by preventing any solids larger than the spaces/openings from passing through the screen 30 toward the apertures 28 of the upper screen housing 12.) The result is that clean fluid is evacuated through the apertures 28 of the upper screen housing 12.

When using the lower screen housing 38, during an upstroke, fluid becomes caught within the channels 49 of the top surfaces of the rings 50. The pressure of the fluid causes the rings 50 to expand outwardly; i.e. the cut ends of each ring 50 separate from each other. This opening/expanding of the rings 50 outwardly against the barrel helps to prevent any solids that might have been small enough to pass through the spaces 34 of the coils 32 of the screen 30 from falling downward toward the plunger 76. (Similarly, in the case of an alternative embodiment of the screen 30 lacking coils 32 but having spaces/openings to allow fluid to flow therethrough, this opening/expanding of the rings 50 outwardly against the barrel helps to prevent any solids that might have been small enough to pass through the spaces/openings of the screen 30 from falling downward toward the plunger 76.) Furthermore, during the upstroke, the rings 50 wipe solids off of the interior of the barrel and collect the solids within the channels 49 of the top surfaces of the rings 50.

When using the lower screen housing 138, during an upstroke, fluid entrained with solids becomes caught within the circular grooves 148, thereby trapping the solids. With the circular grooves 148 trapping the solids in this manner, this helps to prevent any solids that might have been small enough to pass through the spaces 34 of the coils 32 of the screen 30 from falling downward toward the plunger 76. (Similarly, in the case of an alternative embodiment of the screen 30 lacking coils 32 but having spaces/openings to allow fluid to flow therethrough, this trapping of solids by the circular grooves 148 helps to prevent any solids that might have been small enough to pass through the spaces/openings of the screen 30 from falling downward toward the plunger 76) Further, since there are multiple circular grooves 148, any solids that might travel downwardly past one circular groove 148 may be caught within the next circular groove 148 below it.

The screen filter assembly 10 therefore filters the dirty production fluid to help keep the solids off of the plunger 76. By allowing the plunger 76 to move within clean fluid, this helps to prevent wear and tear on the plunger 76.

As mentioned above, the upper screen housing 12 may be coupled to a top plunger adapter 62. In one embodiment, the top plunger adapter 62 may be a collette-style or tubing-style top plunger adapter 62. Preferably, a hollow valve rod will be coupled to a northern end of the top plunger adapter 62. If a hollow valve rod is used, then the top plunger adapter 62 will not have any holes so that all of the dirty fluid will travel upwardly through the hollow valve rod. With a hollow valve rod, all contaminated fluid that passes upwardly through the upper screen housing 12 will continue to travel upwardly through the valve rod and eventually be evacuated about 20-30 feet above the pump. This allows for completely clean fluid to be present above the rings 50 of the lower screen housing 38. With clean fluid being present below the rings 50 and above the rings 50, this provides completely clean fluid for the pump to work in and eliminates any wear on the plunger 76. Similarly, when using the lower screen housing 138, this allows for completely clean fluid to be present above the circular grooves 148 of the lower screen housing 138. With clean fluid being present below the circular grooves 148 and above the circular grooves 148, this provides completely clean fluid for the pump to work in and eliminates any wear on the plunger 76. The hollow valve rod would continue upwardly through the pump barrel and through a valve rod guide into the 3-wing cage.

Alternatively, a solid valve rod may be used instead of a hollow valve rod. A solid valve rod would exhaust clean fluid that exits the upper screen housing 12, creating a buffer zone from the contaminated fluids that are being exhausted just above the apertures 28 of the upper screen housing 12. This allows for completely clean fluid to be present above the rings 50 of the lower screen housing 38. With clean fluid being present below the rings 50 and above the rings 50, this provides completely clean fluid for the pump to work in and eliminates any wear on the plunger 76. Similarly, when using the lower screen housing 138, this allows for completely clean fluid to be present above the circular grooves 148 of the lower screen housing 138. With clean fluid being present below the circular grooves 148 and above the circular grooves 148, this provides completely clean fluid for the pump to work in and eliminates any wear on the plunger 76.

With respect to the screen filter assembly 200 of the present invention, the screen filter assembly 200 may be positioned below a top plunger adapter 62. During a downstroke, dirty fluid enters through the center channel 222 at the bottom portion 220 of the plunger 210, traveling upwardly in the direction of the top portion 212 of the plunger 210. The pressure of the downstroke pushes the dirty fluid outwardly toward the screen 30 within the body 214 of the plunger 210. As the dirty fluid passes through the screen 30, the screen 30 filters the solids from the dirty fluid by preventing any solids larger than the spaces 34 between each coil 32 from passing through the screen 30 toward the apertures 230 of the plunger 210. (Similarly, in the case of an alternative embodiment of the screen 30 lacking coils 32 but having spaces/openings to allow fluid to flow therethrough, the screen 30 filters the solids from the dirty fluid by preventing any solids larger than the spaces/openings in the screen 30 from passing through the screen 30 toward the apertures 230 of the plunger 210.) Thus, the screen 30 retains such solids within the plunger 210, so that they pass through the plunger 210 by way of the center channel 222. This allows clean fluid to be evacuated through the apertures 230 of the plunger 210. This creates an area of clean fluid between the barrel and the plunger 210 in the area of the grooved region 218. Further, the circular grooves 224 in the grooved region 218 of the plunger 210 help to prevent the clean fluid from traveling upwardly and mixing with dirty fluid above the circular grooves 224 near the top portion 212 of the plunger 210. Dirty fluid above the grooved region 218 will tend to slip downward between the barrel and the plunger 210 in the direction of the circular grooves 224.

During an upstroke, the fluid is lifted and the fluid within the center channel 222 is hydrostatic. At this time, the pressure on the dirty fluid located above the grooved region 218 is the same as the pressure on the clean fluid located in the area of the grooved region 218. This creates a hydraulic barrier since the clean fluid has the same pressure acting on it as the dirty fluid. This, in turn, slows the flow of dirty fluid, since the dirty fluid now has to compete with the clean fluid that has been evacuated through the apertures 230, and it helps to prevent the dirty fluid from traveling downward between the barrel and the plunger 210 in the direction of the circular grooves 224. Further, during an upstroke, the fluid entrained with solids becomes caught within the circular grooves 224, thereby trapping the solids. With the circular grooves 224 trapping the solids in this manner, this helps to prevent any solids that might have been small enough to pass through the spaces 34 of the coils 32 of the screen 30 from falling downward in the direction of the bottom portion 220 of the plunger 210 below the grooved region 218. (Similarly, in the case of an alternative embodiment of the screen 30 lacking coils 32 but having spaces/openings to allow fluid to flow therethrough, this helps to prevent any solids that might have been small enough to pass through the spaces/openings in the screen 30 from falling downward in the direction of the bottom portion 220 of the plunger 210 below the grooved region 218.) Further, since there are multiple circular grooves 224, any solids that might travel downwardly past one circular groove 224 may be caught within the next circular groove 224 below it. Further, during an upstroke, solids are collected at the top edge 243 of the top portion 212 of the plunger 210, thereby helping to keep the solids from away from the area between the plunger 210 and pump barrel in this region.

The screen filter assembly 200 therefore filters the dirty production fluid to help keep the solids off of the bottom portion 220 and body 214 of the plunger 210 below the grooved region 218. Further, the screen filter assembly 200 also creates fluid dynamics, as described herein, resulting in a cleaner fluid environment for the plunger 210. By allowing the bottom portion 220 and body 214 of the plunger 210 below the grooved region 218 to move within clean fluid, this helps to prevent wear and tear on the plunger 210.

As mentioned above, the screen filter assembly 200 may be coupled to a top plunger adapter 62. In one embodiment, the top plunger adapter 62 may be a collette-style or tubing-style top plunger adapter 62. Preferably, a hollow valve rod will be coupled to a northern end of the top plunger adapter 62. If a hollow valve rod is used, then the top plunger adapter 62 will not have any holes so that all of the dirty fluid will travel upwardly through the hollow valve rod. With a hollow valve rod, all contaminated fluid that passes upwardly through the center channel 222 of the plunger 210 will continue to travel upwardly through the valve rod and eventually be evacuated about 20-30 feet above the pump. This allows for completely clean fluid to be present above the grooved region 218. With clean fluid being present below the grooved region 218 and above the grooved region 218, this provides completely clean fluid for the pump to work in and eliminates any wear on the plunger 210. The hollow valve rod would continue upwardly through the pump barrel and through a valve rod guide into the 3-wing cage.

Alternatively, a solid valve rod may be used instead of a hollow valve rod. A solid valve rod would exhaust clean fluid that exits the apertures 230, creating a buffer zone from the contaminated fluids that are being exhausted just above the apertures 230. This allows for completely clean fluid to be present above the grooved region 218. With clean fluid being present below the grooved region 218 and above the grooved region 218, this provides completely clean fluid for the pump to work in and eliminates any wear on the plunger 210.

The foregoing description is illustrative of particular embodiments of the application, but is not meant to be limitation upon the practice thereof. While embodiments of the disclosure have been described in terms of various specific embodiments, those skilled in the art will recognize that the embodiments of the disclosure may be practiced with modifications within the spirit and scope of the claims.

What is claimed is:

1. A screen filter assembly for use with a pump system comprising:

a plunger, wherein the plunger comprises:

a top portion;

a body;

a center channel formed through the top portion and through the body; and a plurality of apertures extending through the body into the center channel; and a screen housed within the body of the plunger, wherein a plurality of veins are formed on an interior surface of the screen.

2. The screen filter assembly of claim 1 wherein the top portion of the plunger has a top edge that is angled downwardly and inwardly toward the center channel of the plunger.

3. The screen filter assembly of claim 1 wherein the plunger further comprises:

a plurality of circular flanges formed on an outer surface of the body of the plunger; and a plurality of circular grooves formed by and positioned between the circular flanges, wherein the plurality of apertures of the plunger are formed within the circular grooves.

4. The screen filter assembly of claim 3 wherein the outer surface of the body of the plunger is tapered so that the circular flanges have outer diameters that increase when going from top to bottom.

5. The screen filter assembly of claim 3 wherein each circular flange on the outer surface of the body of the plunger has a top edge that is angled downwardly and inwardly toward the center channel of the plunger.

6. The screen filter assembly of claim 3 wherein the plurality of apertures within the circular grooves of the plunger are positioned diagonally to the center channel of the plunger.

7. The screen filter assembly of claim 1, further comprising:

threading positioned on the top portion of the plunger;

threading positioned on the body of the plunger; and a thread masher region adapted to receive at least one thread of the threading on the body of the plunger;

wherein the threading on the top portion of the plunger is configured to mate with the threading on the body of the plunger.

8. The screen filter assembly of claim 7 further comprising a retainer ring positioned within the body of the plunger.

9. The screen filter assembly of claim 8 wherein the retainer ring comprises:

a top edge adapted to mate with the top portion of the plunger;

a bottom edge adapted to mate with the screen; and an interlocking region juxtaposed between the top edge and bottom edge, wherein the interlocking region is adapted to mate with an interlocking, region of the body of the plunger.

10. The screen filter assembly of claim 1 wherein the veins have a triangular shape.

11. A screen filter assembly for use with a pump system comprising:

a plunger, wherein the plunger comprises:

a top portion;

a body;

a center channel formed through the top portion and through the body;

a plurality of circular flanges formed on an outer surface of the body;

a plurality of circular grooves formed by and positioned between the circular flanges; and a plurality of apertures formed within the circular grooves and extending through the body into the center channel;

wherein the top portion of the plunger has a top edge that is angled downwardly and inwardly toward the center channel of the plunger;

a screen housed within the body of the plunger; and a retainer ring positioned within the body of the plunger, wherein the retainer ring comprises:

a top edge adapted to mate with the top portion of the plunger;

a bottom edge adapted to mate with the screen; and an interlocking region juxtaposed between the top edge and bottom edge, wherein the interlocking region is adapted to mate with an interlocking region of the body of the plunger.

12. The screen filter assembly of claim 11 wherein the plurality of apertures within the circular grooves of the plunger are positioned diagonally to the center channel of the plunger.

13. The screen filter assembly of claim 11 further comprising:

threading positioned on the top portion of the plunger;

threading positioned on the body of the plunger; and a thread masher region adapted to receive at least one thread of the threading on the body of the plunger;

wherein the threading on the top portion of the plunger is configured to mate with the threading on the body of the plunger.

14. A method for filtering solids within a pump barrel of a pump system comprising the steps of:

providing a screen filter assembly comprising:

a plunger, wherein the plunger comprises:

a top portion;

a body;

a center channel formed through the top portion and through the body; and a plurality of apertures extending through the body into the center channel; and a screen housed within the body of the plunger, wherein a plurality of veins are formed on an interior surface of the screen;

passing dirty pumped fluid upwardly through the plunger during a downstroke;

filtering the dirty pumped fluid through the screen;

evacuating clean fluid out of the apertures of the plunger; and continuing to pass the dirty pumped fluid upwardly through the center channel of the plunger during the downstroke.

15. A screen filter assembly for use with a pump system comprising:

a plunger, wherein the plunger comprises:

a top portion;

a body;

a center channel formed through the top portion and through the body; and a plurality of apertures extending through the body into the center channel;

threading positioned on the top portion of the plunger;

threading positioned on the body of the plunger; and a thread masher region adapted to receive at least one thread of the threading on the body of the plunger;

wherein, the threading on the top portion of the plunger is configured to mate with the threading on the body of the plunger;

a screen housed within the body of the plunger; and a retainer ring positioned within the body of the plunger, wherein the retainer ring comprises:

a top edge adapted to mate with the top portion of the plunger;

a bottom edge adapted to mate with the screen; and an interlocking region juxtaposed between the top edge and bottom edge, wherein the interlocking region is adapted to mate with an interlocking region on the body of the plunger.

* * * * *